US011156405B2

(12) United States Patent
Blomgren

(10) Patent No.: US 11,156,405 B2
(45) Date of Patent: Oct. 26, 2021

(54) HEAT TRANSFER PLATE AND GASKET

(71) Applicant: ALFA LAVAL CORPORATE AB, Lund (SE)

(72) Inventor: Fredrik Blomgren, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 17/253,643

(22) PCT Filed: Jun. 17, 2019

(86) PCT No.: PCT/EP2019/065885
§ 371 (c)(1),
(2) Date: Dec. 18, 2020

(87) PCT Pub. No.: WO2020/002027
PCT Pub. Date: Jan. 2, 2020

(65) Prior Publication Data

US 2021/0247144 A1 Aug. 12, 2021

(30) Foreign Application Priority Data

Jun. 28, 2018 (EP) ..... 18180285

(51) Int. Cl.
*F28D 9/00* (2006.01)
*F28F 3/10* (2006.01)
*F28F 3/04* (2006.01)

(52) U.S. Cl.
CPC ..... *F28D 9/005* (2013.01); *F28F 3/046* (2013.01); *F28F 3/10* (2013.01)

(58) Field of Classification Search
CPC ..... F28D 9/005; F28D 9/0043; F28D 9/0037; F28F 3/046; F28F 3/042; F28F 3/08;
(Continued)

(56) References Cited

U.S. PATENT DOCUMENTS 3,760,873 A 9/1973 Wright
4,063,591 A 12/1977 Usher
(Continued)

FOREIGN PATENT DOCUMENTS

EP 3182048 A1 6/2017
GB 1129405 A 10/1968
(Continued)

OTHER PUBLICATIONS

International Search Report (PCT/ISA/210) dated Sep. 27, 2019, by the European Patent Office as the International Searching Authority for International Application No. PCT/EP2019/065885.
(Continued)

*Primary Examiner* — Joel M Attey
*Assistant Examiner* — For K Ling
(74) *Attorney, Agent, or Firm* — Buchanan Ingersoll & Rooney PC

(57) ABSTRACT

A heat transfer plate comprises at least one first port hole area and opposing front and back sides, first and second planes defining the extension of the plate. Each first port hole area comprises a first port hole defined by an annular first inner edge of the plate, with the first inner edge consisting of first and second sections. Each first port hole area further comprises an annular first inner port portion extending along the first and second sections. The first inner port portion comprises, as seen from the front side of the plate, a number ≥1 of first support projections along the second section of the first inner edge, each first support projections comprising a first top portion extending in the first plane. The plate extends, within the first inner port portion and outside first support projections, at a distance ≠0 from the first and second planes.

17 Claims, 12 Drawing Sheets

(58) Field of Classification Search
CPC .... F28F 3/083; F28F 3/086; F28F 3/10; F28F 3/044; F28F 3/04
See application file for complete search history.

(56) References Cited

U.S. PATENT DOCUMENTS

| | | | | |
|---|---|---|---|---|
| 5,443,115 | A * | 8/1995 | Pedersen | F28F 3/10 165/70 |
| 5,924,484 | A * | 7/1999 | Andersson | F28F 3/083 165/167 |
| 5,971,065 | A * | 10/1999 | Bertilson | F28F 9/026 165/153 |
| 7,490,660 | B2 | 2/2009 | Song | |
| 9,217,608 | B2 | 12/2015 | Krantz et al. | |
| 10,871,333 | B2 * | 12/2020 | Hedberg | F28F 3/083 |
| 2006/0048927 | A1 * | 3/2006 | Blomgren | F28D 9/005 165/167 |
| 2008/0196873 | A1 | 8/2008 | Svensson | |
| 2011/0024097 | A1 * | 2/2011 | Christensen | F28F 3/046 165/166 |
| 2011/0247790 | A1 * | 10/2011 | Holm | F28F 3/046 165/168 |

FOREIGN PATENT DOCUMENTS

| | | | |
|---|---|---|---|
| GB | 1460422 | A | 1/1977 |
| GB | 2028996 | B | 12/1982 |
| GB | 2071303 | B | 12/1983 |
| JP | H06300475 | A | 10/1994 |
| JP | H11-210885 | A | 8/1999 |
| JP | 2005106407 | A | 4/2005 |
| JP | 4044521 | B2 | 2/2008 |
| KR | 20-0344180 | Y1 | 3/2004 |
| RU | 2413916 | C2 | 3/2011 |
| SU | 1343233 | A1 | 10/1987 |
| WO | 03/006911 | A1 | 1/2003 |
| WO | 2007/073305 | A1 | 6/2007 |
| WO | 2009080692 | A1 | 7/2009 |
| WO | 2010056183 | A2 | 5/2010 |
| WO | 2010056183 | A3 | 5/2010 |
| WO | 2010071551 | A2 | 6/2010 |
| WO | 2010071551 | A3 | 6/2010 |

OTHER PUBLICATIONS

Written Opinion (PCT/ISA/237) dated Sep. 27, 2019, by the European Patent Office as the International Searching Authority for International Application No. PCT/EP2019/065885.

New—GEA's NW350 Wide Gap Plate!, Pentad Assocates, Inc., Source: https://www.pentadassoc.com/blog/new-gea-s-nw350-wide-gap-plate; Sep. 30, 2014.

English translation of Decision to Grant and Search Report dated Jun. 7, 2021, by the Russian Patent Office in corresponding Russian Patent Application No. 2021101401. (10 pages).

Office Action (First Examination Report) dated Jul. 27, 2021, by the Patent Office, Government of India, in corresponding India Patent Application No. 202017052788 with an English Translation of the Office Action. (6 pages).

* cited by examiner

HEAT TRANSFER PLATE AND GASKET

TECHNICAL FIELD

The invention relates to a heat transfer plate comprising at least one port hole area comprising a port hole defined by an annular inner edge of the heat transfer plate, wherein a gasket groove on one side of the heat transfer plate extends completely around the port hole and a gasket groove on the other side of the heat transfer plate extends only partly around the port hole. The invention also relates to a gasket for sealing between two adjacent heat transfer plates in a plate heat exchanger, which gasket comprises at least one annular gasket part arranged to seal around two overlapping port holes in the heat transfer plates.

BACKGROUND ART

Plate heat exchangers, PHEs, typically consist of two end plates in between which a number of heat transfer plates are arranged in an aligned manner, i.e. in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other.

In one type of well-known PHEs, the so called gasketed PHEs, gaskets are arranged between, and in gasket grooves in, the heat transfer plates which comprises corrugations, such as corrugated or wave-shaped inner and outer edges. The end plates, and therefore the heat transfer plates, are pressed towards each other by some kind of tightening means whereby corrugations of each of the heat transfer plates abut corrugations of the adjacent heat transfer plates and the gaskets seal between the heat transfer plates. The gaskets define parallel flow channels between the heat transfer plates, one channel between each pair of heat transfer plates. Two fluids of initially different temperatures can flow through every second channel for transferring heat from one fluid to the other.

The fluids enter and exit the channels through inlet and outlet ports, respectively, which extend through the PHE and are formed by respective aligned port holes in the heat transfer plates and the gaskets sealing, completely or partly, around the port holes. The port holes in the heat transfer plates are typically defined by corrugated inner edges of the heat transfer plates, and the gasket grooves extending completely or partly around the port holes are typically arranged immediately outside the corrugated inner edges. The inlet and outlet ports communicate with inlets and outlets, respectively, of the PHE for feeding the fluids to and from the PHE.

The purpose of having the outer and inner edges corrugated is, as mentioned above, to provide support points between the heat transfer plates in the PHE to prevent deflection of heat transfer plates which could result in a leaking PHE.

As said above, in a gasketed PHE, corrugations of each of the heat transfer plates abut corrugations of the adjacent heat transfer plates while the gaskets seal between the heat transfer plates. For example, the corrugations of the outer and inner edges of each of the heat transfer plates abut the corrugations of the outer and inner edges, respectively, of the adjacent heat transfer plates. This means that the outer and inner edges of, for example, the tenth heat transfer plate of the plate pack alternately will abut the outer and inner edges, respectively of the ninth and eleventh heat transfer plates and, in between, no heat transfer plate at all. This will result in empty gaps between the heat transfer plates. In the so formed empty gaps between the corrugated or wave-shaped inner edges of the heat transfer plates, fibers and particles from the fluids flowing through the inlet and outlet ports of the PHE may be caught between the abutting heat transfer plates. This may be a problem, especially in sanitary or hygienic applications.

SUMMARY

An object of the present invention is to provide a heat transfer plate and a gasket that solves the above mentioned problem. The basic concept of the invention is to design the heat transfer plate and the gasket such that empty gaps of the above mentioned kind is not formed in a plate pack containing a plurality of such heat transfer plate and gaskets. The heat transfer plate and the gasket according to the invention are defined in the appended claims and discussed below.

A heat transfer plate according to the present invention, also referred to herein as just "plate", comprises at least one first port hole area, opposing front and back sides and an outer edge portion. The outer edge portion comprises corrugations extending between and in first and second planes defining the extension of the heat transfer plate. The first and second planes are parallel to each other and to an intermediate plane extending between the first and second planes. The front and back sides of the heat transfer plate face the first and second planes, respectively. Each of said at least one first port hole area comprises a first port hole defined by an annular first inner edge of the heat transfer plate. Said first inner edge consists of a first and a second section, which first section is 25-65% of the first inner edge. The heat transfer plate further comprises a front gasket groove on the front side of the heat transfer plate, which extends along the first section of said first inner edge, and a back gasket groove on the back side of the heat transfer plate, which extends along the first and second sections of said first inner edge. Each of said at least one first port hole area further comprises an annular first inner port portion extending along the first and second sections of said first inner edge, a first intermediate port portion encircling, partly or completely, the first inner port portion, and a first outer port portion encircling, partly or completely, the first intermediate port portion. The front and back gasket grooves extend within the first inner, intermediate and outer port portions.

The heat transfer plate is characterized in that the first inner port portion comprises, as seen from the front side of the heat transfer plate, a number ≥1 of first support projections along the second section of the first inner edge. Each of said number of first support projections comprises a first top portion extending in the first plane. Further, the heat transfer plate extends, within the first inner port portion and outside said number of first support projections, at a distance ≠0 from the first and second planes.

The expressions "front side" and "back side" are used only to distinguish between the opposing sides of the heat transfer plate and do not impose, on the plate sides, any specific characteristics or requirements, e.g. as regards orientation in a PHE. The front side could just as well be called the back side and vice versa.

The corrugations of the outer edge portion of the heat transfer plate comprises alternately arranged ridges and valleys arranged to abut ridges and valleys of adjacent heat transfer plates in a PHE. The outer edge portion of the heat transfer plate may comprise corrugations along its complete, or only one or more parts of its, extension.

The intermediate plane may, but does not have to, be arranged half way between the first and second planes in which the "extreme points" of the heat transfer plate are arranged.

"Annular" as used herein, does not necessarily mean "circular" but covers all "closed" forms, such as oval, triangular, etc.

The first and second sections of the first inner edge of the heat transfer plate are both continuous.

The front gasket groove may or may not extend also along at least a portion of the second section of the first inner edge of the heat transfer plate.

The first inner port portion extends along the complete first and second sections of the first inner edge of the heat transfer plate, i.e. around the first porthole so as to completely encircle it.

For example, a heat transfer plate according to the invention may be rectangular or circular. By a rectangular, or essentially rectangular heat transfer plate is meant a heat transfer plate having two opposing parallel long sides and two opposing parallel short sides, possibly provided with recesses for receiving guiding and carrying bars for mounting of the plate in a PHE, as is well-known, and cropped or non-cropped corners.

Typically, in the case of an essentially rectangular heat transfer plate, the first section of the first inner edge of the heat transfer plate extends, at least partly, between the first port hole and the closest one of the short sides and, and between the first port hole and the closest one of the long sides.

By the expression "as seen from the front side of the heat transfer plate" is here meant what the heat transfer plate looks like when the front side of it is viewed at a distance.

One or more of the first support projections may extend into the first intermediate port portion, and possibly also into the first outer port portion.

As said above, the first inner port portion of the heat transfer plate comprises a number of first support projections along the second section of the first inner edge, and a first top portion of these first support projections extends in the first plane. This means that the first support projections of the heat transfer plate, when this is arranged properly in a PHE between two adjacent heat transfer plates according to the invention, may abut respective support projections of the adjacent heat transfer plate facing the front side of the heat transfer plate in question. Further, as said above, the complete first inner port portion of the heat transfer plate except for the first support projections extends, at a distance $\neq 0$ from the first and second planes, i.e. between the first and second planes. This means that the heat transfer plate, when arranged properly in a PHE between two adjacent heat transfer plates according to the invention, may be separated from the adjacent heat transfer plate facing the back side of the heat transfer plate within the complete first inner port portion, and may be separated from the adjacent heat transfer plate facing the front side of the heat transfer plate within the complete first inner port portion except for at the first support projections. Consequently, within the first inner port portion of the heat transfer plate in question, the contact with the adjacent heat transfer plates may be very limited. This means that the risk of fibers and particles from the fluids flowing through the PHE getting caught between the heat transfer plate and the adjacent heat transfer plates may be relatively very small. This is a huge advantage, especially in sanitary or hygienic applications. Also, this means that the front and back gasket grooves may be allowed to extend close to the first inner edge, which may make the heat transfer plate more area efficient.

The heat transfer plate may extend, within the first inner port portion and outside said number of first support projections, in the same plane as the first inner edge, along the first inner edge. Thus, the complete first inner port portion of the heat transfer plate, possibly except for the first support projections, may extend "flush with" the first inner edge. The first inner edge, and thus the heat transfer plate within the first inner port portion and outside said number of first support projections, may extend in different planes along its extension, and these planes may or may not be parallel to the intermediate plane. Thus, the first inner port portion and the first inner edge, outside said number of first support projections, may be in line with an infinite imaginary straight line extending from a center axis through a center of the first port hole, which center axis is perpendicular to the intermediate plane. Such an imaginary straight line may or may not be parallel to the intermediate plane. This embodiment may decrease, even further, the risk of fibers and particles from the fluids flowing through the PHE getting caught between the heat transfer plate and the adjacent heat transfer plates.

The first inner port portion of the heat transfer plate may have different designs, such be wave-shaped and/or inclined as viewed from inside the first port hole. According to one embodiment of the inventive heat transfer plate, the first inner port portion is essentially plane and extends in the intermediate plane along the complete first section of the first inner edge. This means that the first port hole, at least along the first section of the first inner edge defining the first port hole, will be surrounded by a plane plate edge, which may be optimum from a hygienic point of view. Such a design may also be mechanically straightforward and allow a mechanically uncomplicated design of the gaskets to be used together with the heat transfer plate.

The heat transfer plate may be such that each of the first top portions of said number of first support projections extends from the first inner edge. This means that each of the first top portions of said number of first support projections comprises a respective part of the first inner edge, which, thus, extends in the first plane. Such a design may be optimum from a hygienic point of view. It may also be mechanically straightforward and allow a mechanically uncomplicated design of the gaskets to be used together with the heat transfer plate.

The first intermediate port portion of the heat transfer plate may comprise, as seen from the front side of the heat transfer plate, a number $\geq 1$ of positioning projections and a number $\geq 1$ of positioning recesses along the first section of the first inner edge. The positioning projections may extend to a fourth plane arranged between the intermediate plane and the first plane, and the positioning recesses may extend to a third plane arranged between the intermediate plane and the second plane. The positioning projections and recesses may, or may not, be alternately arranged. Further, the positioning projections and recesses may, or may not, all be arranged at the same distance form the first inner edge. As indicated by the names, the positioning projections may be arranged to correctly position and maintain a gasket in the front gasket groove, while the positioning recesses may be arranged to correctly position and maintain a gasket in the back gasket groove.

The first intermediate port portion of the heat transfer plate may comprise, as seen from the front side of the heat transfer plate, a number ≥1 of positioning recesses along the second section of the first inner edge. These positioning recesses may extend to a fifth plane arranged between the intermediate plane and the second plane. This fifth plane may, or may not, be the same as the third plane. Further, these positioning recesses may, or may not, all be arranged at the same distance from the first inner edge. As indicated by the name, the positioning recesses may be arranged to correctly position and maintain a gasket in the back gasket groove.

The number of first support projections along the second section of the first inner edge may be >1, and the first inner port portion may extend, between two adjacent ones of the first support projections, between, i.e. in a volume between, the intermediate plane and the second plane. The first inner port portion may, for example, be curved or bent away from the intermediate plane for an increased heat transfer plate strength. The first inner port portion may, from the first section of the first inner edge to the outermost ones of the first support projections, be essentially plane and extend in the intermediate plane, or, alternatively, extend between, i.e. in a volume between, the intermediate plane and the second plane.

The heat transfer plate may be so designed that the first outer port portion is essentially plane, and extends in the intermediate plane, along the complete first and second sections of the first inner edge. Such a design may be mechanically straightforward and allow a mechanically uncomplicated design of the gaskets to be used together with the heat transfer plate.

The heat transfer plate may further comprise at least one second port hole area. Each of said at least one second port hole area comprises a second port hole defined by an annular second inner edge of the heat transfer plate. Said second inner edge consists of a first and a second section, which first section is 25-65% of the second inner edge. The front gasket groove extends along the first and second sections of said second inner edge. The back gasket groove extends along the first section of said second inner edge. Each of said at least one second port hole area further comprises an annular second inner port portion extending along the first and second sections of said second inner edge, a second intermediate port portion encircling, partly or completely, the second inner port portion, and a second outer port portion encircling, partly or completely, the second intermediate port portion. The front and back gasket grooves extend within the second inner, intermediate and outer port portions. The second inner port portion comprises, as seen from the back side of the heat transfer plate, a number ≥1 of second support projections along the second section of the second inner edge. Each of said number of second support projections comprises a second top portion extending in the second plane. The heat transfer plate extends, within the second inner port portion and outside said number of second support projections, at a distance ≠0 from the first and second planes.

The first and second sections of the second inner edge of the heat transfer plate are both continuous.

The back gasket groove may or may not extend also along at least a portion of the second section of the second inner edge of the heat transfer plate.

The second inner port portion extends along the complete first and second sections of the second inner edge of the heat transfer plate, i.e. around the second porthole so as to completely encircle it.

Typically, in the case of an essentially rectangular heat transfer plate, the first section of the second inner edge of the heat transfer plate extends, at least partly, between the second port hole and the closest one of the short sides and, and between the second port hole and the closest one of the long sides.

By the expression "as seen from the back side of the heat transfer plate" is here meant what the heat transfer plate looks like when the back side of it is viewed at a distance.

One or more of the second support projections may extend into the second intermediate port portion, and possibly also into the second outer port portion.

Since the second top portions of the second support projections extend in the second plane, the second support projections of the heat transfer plate, when this is arranged properly in a PHE between two adjacent heat transfer plates according to the invention, may abut respective support projections of the adjacent heat transfer plate facing the back side of the heat transfer plate in question. Further, since the complete second inner port portion except for the second support projections extends at a distance from the first and second planes, the heat transfer plate, when arranged properly in a PHE between two adjacent heat transfer plates according to the invention, may be separated from the adjacent heat transfer plate facing the front side of the heat transfer plate within the complete second inner port portion, and may be separated from the adjacent heat transfer plate facing the back side of the heat transfer plate within the complete second inner port portion except for at the second support projections. Consequently, within the second inner port portion of the heat transfer plate in question, the contact with the adjacent heat transfer plates may be very limited. This means that the risk of fibers and particles from the fluids flowing through the PHE getting caught between the heat transfer plate and the adjacent heat transfer plates may be relatively very small. Again, this is a huge advantage, especially in sanitary or hygienic applications. Also, this means that the front and back gasket grooves may be allowed to extend close to the second inner edge, which may make the heat transfer plate more area efficient.

The front gasket groove may be formed in one or more pieces. The same goes for the back gasket groove.

The heat transfer plate may extend, within the second inner port portion and outside said number of second support projections, in the same plane as the second inner edge, along the second inner edge. Thus, the complete second inner port portion of the heat transfer plate, possibly except for the second support projections, may extend "flush with", the second inner edge. The second inner edge, and thus the heat transfer plate within the second inner port portion and outside said number of second support projections, may extend in different planes along its extension, and these planes may or may not be parallel to the intermediate plane. Thus, the second inner port portion and the second inner edge, outside said number of second support projections, may be in line with an infinite imaginary straight line extending from a center axis through a center of the second port hole, which center axis is perpendicular to the intermediate plane. Such an imaginary straight line may or may not be parallel to the intermediate plane. This embodiment may decrease, even further, the risk of fibers and particles from the fluids flowing through the PHE getting caught between the heat transfer plate and the adjacent heat transfer plates.

The second port hole area may have other features corresponding to the above possible features of the first port-hole area.

The heat transfer plate may be such that longitudinal and transverse centre axes of the heat transfer plate, which extend parallel to the intermediate plane and perpendicular to each other, define a first, a second, a third and a fourth plate area. The first and second plate areas are arranged on the same side of the transverse centre axis and the first and the third plate areas are arranged on the same side of the longitudinal centre axis. The first and third plate areas may each comprise one of said at least one first port hole area and the second and fourth plate areas may each comprise one of said at least one second port hole area. The first and second port hole areas may be symmetrically arranged with reference to the transverse and longitudinal centre axes. By this design, the heat transfer plate may be arranged with other heat transfer plates according to the invention in a plate pack in which the heat transfer plates are "rotated" in relation to each other, or in which the heat transfer plates are "flipped" in relation to each other.

The first port hole areas of the first and third plate areas have the features specified in claim 1, and possible the features specified in claims 2-8. They may be similarly or differently designed. Correspondingly, the second port hole areas of the second and fourth plate areas have the features specified in claim 9, and possible the features specified in claims 10. They may be similarly or differently designed.

A gasket according to the present invention is arranged for sealing between two adjacent heat transfer plates, for example two heat transfer plates according to the present invention, in a plate heat exchanger. It comprises opposing front and back sides configured to abut a respective one of the heat transfer plates. Further, it comprises at least one annular gasket part configured to seal around two overlapping port holes in the heat transfer plates. An inner edge of the annular gasket part consists of a first and a second section, which first section is 25-65% of the inner edge. The annular gasket part comprises an annular inner gasket portion defining, and extending along the first and second sections of, the inner edge of the annular gasket part, an intermediate gasket portion encircling, partly or completely, the inner gasket portion and an outer gasket portion encircling, partly or completely, the intermediate gasket portion. The gasket is characterized in that the inner gasket portion has a maximum thickness t1 along the complete inner edge except for at a number ≥1 of locations along the second section of the inner edge. At each of said locations, the inner gasket portion comprises a projection projecting from the front side and a projection projecting from the back side so as to give the inner gasket portion a maximum thickness t2, t2>t1.

It should be stressed that the claims and the summary describe the gasket in an unloaded and non-deformed state.

Two parallel reference planes define the extension of the gasket, i.e. the gasket does not extend beyond these reference planes. The front side of the gasket faces one of the reference planes while the back side of the gasket faces the other one of the reference planes. A respective top portion of the projections may extend in one each of the reference planes.

The expressions "front side" and "back side" are used only to distinguish between the opposing sides of the gasket and do not impose, on the gasket, any specific characteristics or requirements, e.g. as regards orientation between the adjacent heat transfer plates. The front side could just as well be called the back side and vice versa.

The first and second sections of the inner edge of the annular gasket part are both continuous.

The intermediate and outer gasket portions of the annular gasket part may be continuous or discontinuous.

The inner gasket portion extends along the complete first and second sections of the inner edge of the annular gasket part.

The projections at each of said locations may be aligned and may have similar shapes and sizes. Further, all or some of the projections may have similar shapes and sizes.

One or more of the projections may extend into the intermediate gasket portion, and possibly also into the outer gasket portion.

The thickness of the gasket is measured perpendicular to the reference planes and to a longitudinal extension of the gasket. By maximum thickness is meant that the thickness of the gasket is measured where the gasket is the thickest.

In that the annular gasket part comprises pairwise arranged projections extending from opposite sides of the gasket arranged to abut a respective one of the adjacent heat transfer plates, the annular gasket portion may, as will be described in more detail later, completely fill out the space between the two adjacent heat transfer plates according to the present invention. This is beneficial from a hygienic point of view.

Depending on the design of the gasket, one of the inner and outer gasket portions of the annular gasket part may be arranged to be deformed to seal between the adjacent plates, while the other one may be arranged to, without being substantially deformed, position and maintain the gasket properly between the adjacent plates.

The gasket may have different cross sections. As an example, the inner and/or the outer gasket portion of the annular gasket part may have a plane back side and a pointed front side. As another example, the inner and/or the outer gasket portion of the annular gasket part may have plane and possibly parallel back and front sides. Further, the back and/or front sides could be provided with one or more beads extending along the gasket along its complete, or only part of its, extension.

According to one embodiment of the inventive gasket, the inner gasket portion has an essentially constant cross section along the complete first section of the inner edge. This may enable a relatively structurally uncomplicated gasket and also a straightforward, uncomplicated design of the heat transfer plates to be used together with the gasket.

The outer gasket portion may have an essentially constant cross section and a maximum thickness t3 along its complete extension.

t1, t2 and t3 may be constant or vary along the gasket.

The intermediate gasket portion of the annular gasket part may have, along its complete extension, a thickness ≤t3, and, along at least a part of its extension, a thickness <t3. Such a design may facilitate correct positioning and retention of the gasket between the adjacent heat transfer plates.

The number of locations of increased maximum thickness along the second section of the inner edge may be >1. Further, the maximum thickness of the inner gasket portion may be locally decreased, in relation to the maximum thickness of the inner gasket portion along the first section of the inner edge, between two adjacent ones of the locations.

The gasket may be so designed that an inner surface of the inner gasket portion extending between the front and back sides of the gasket is convex, i.e. bulging outwards, along at least a part of the second section of the inner edge. Such a rounded inner surface of the gasket may facilitate the entrance of the fluids flowing through the PHE into the channels between the heat transfer plates and prevent that fibers and particles from the fluids get caught at the gasket.

A heat transfer plate according to the present invention and a gasket according to the present invention may form a unit wherein the annular gasket part of the gasket is arranged in the back gasket groove of the heat transfer plate with the gasket front side contacting the heat transfer plate. The inner gasket portion, the intermediate gasket portion and the outer gasket portion of the annular gasket part engage the first inner port portion, the first intermediate port portion and the first outer port portion, respectively, of the heat transfer plate, whereby the annular gasket part completely encircles the first port hole. Further, the first and second sections of the first inner edge of the annular gasket part extend along the first and second sections of the first inner edge of the heat transfer plate, respectively, such that the projections projecting from the gasket front side are received in a respective recess of recesses formed by the first support projections.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1:
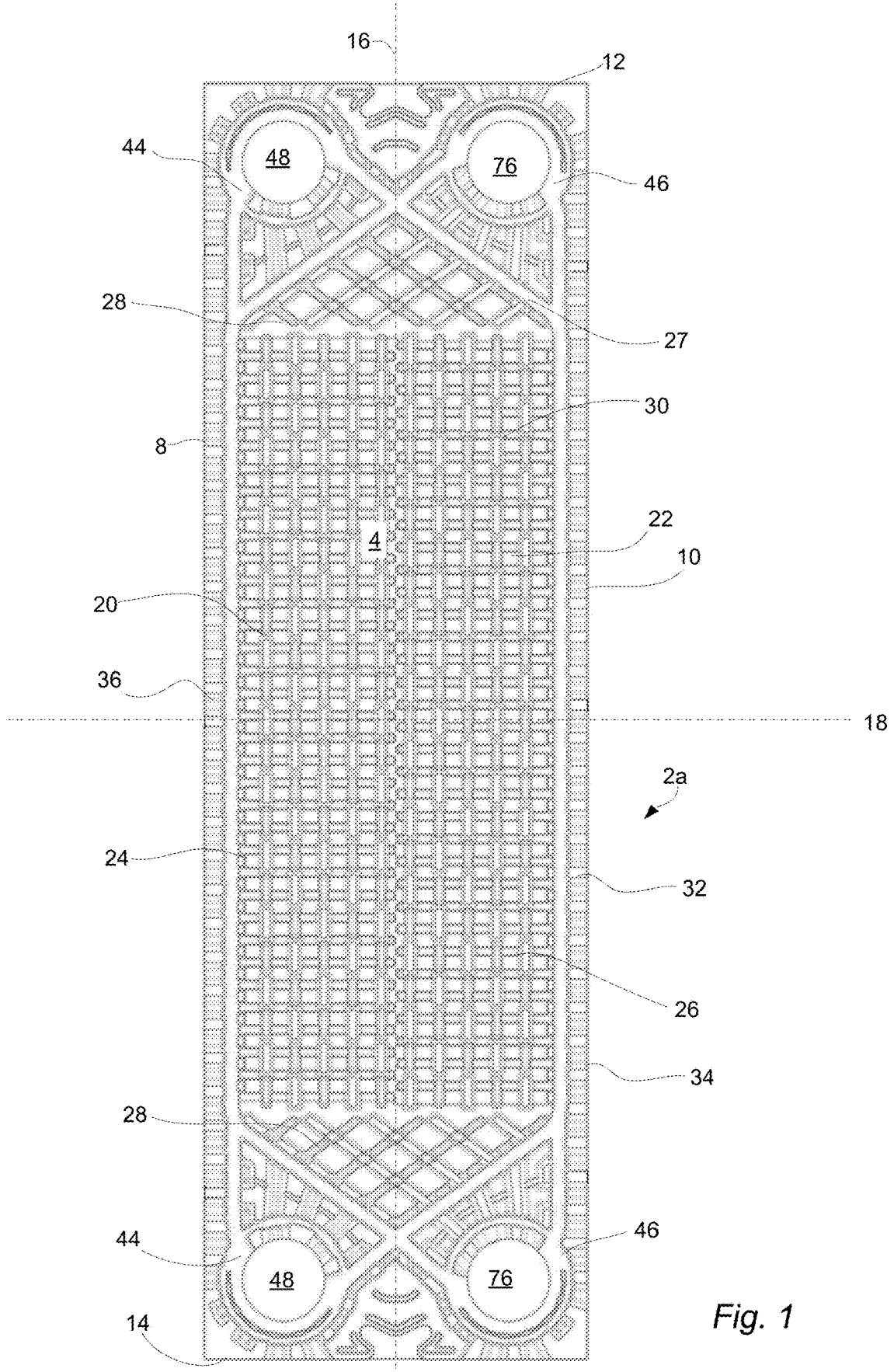
FIG. 1 is a schematic plan view of a heat transfer plate.

FIG. 1 shows a heat transfer plate 2*a* of a gasketed plate heat exchanger as described by way of introduction. The gasketed PHE, which is not illustrated in full, comprises a pack of heat transfer plates 2 like the heat transfer plate 2*a*, i.e. a pack of similar heat transfer plates, separated by gaskets, which also are similar and which will be described in further detail below. In the plate pack, the heat transfer plates, which each has a front side 4 (illustrated in FIG. 1) and a back side 6 (not visible in FIG. 1 but indicated in FIG. 2), are arranged with the front side 4 of one heat transfer plate facing the front side 4 of a neighboring heat transfer plate, and every second heat transfer plate turned upside-down in relation to a reference orientation (illustrated in FIG. 1).

The heat transfer plate 2*a* is an essentially rectangular sheet of stainless steel. It comprises two opposing long sides 8, 10 and two opposing short sides 12, 14. The heat transfer plate further has a longitudinal centre axis 16 extending parallel to, and half way between, the long sides 8, 10 and a transverse centre axis 18 extending parallel to, and half way between, the short sides 12, 14, and thus perpendicular to the longitudinal centre axis 16. The longitudinal and transverse centre axes divide the heat transfer plate 2*a* into four equally large first, second, third and four plate areas, 20, 22, 24 and 26, respectively. The first and second plate areas 20 and 22 are arranged on the same side of the transverse centre axis 18 while the first and the third plate areas 20 and 24 are arranged on the same side of the longitudinal centre axis 16.

Figure 7A:
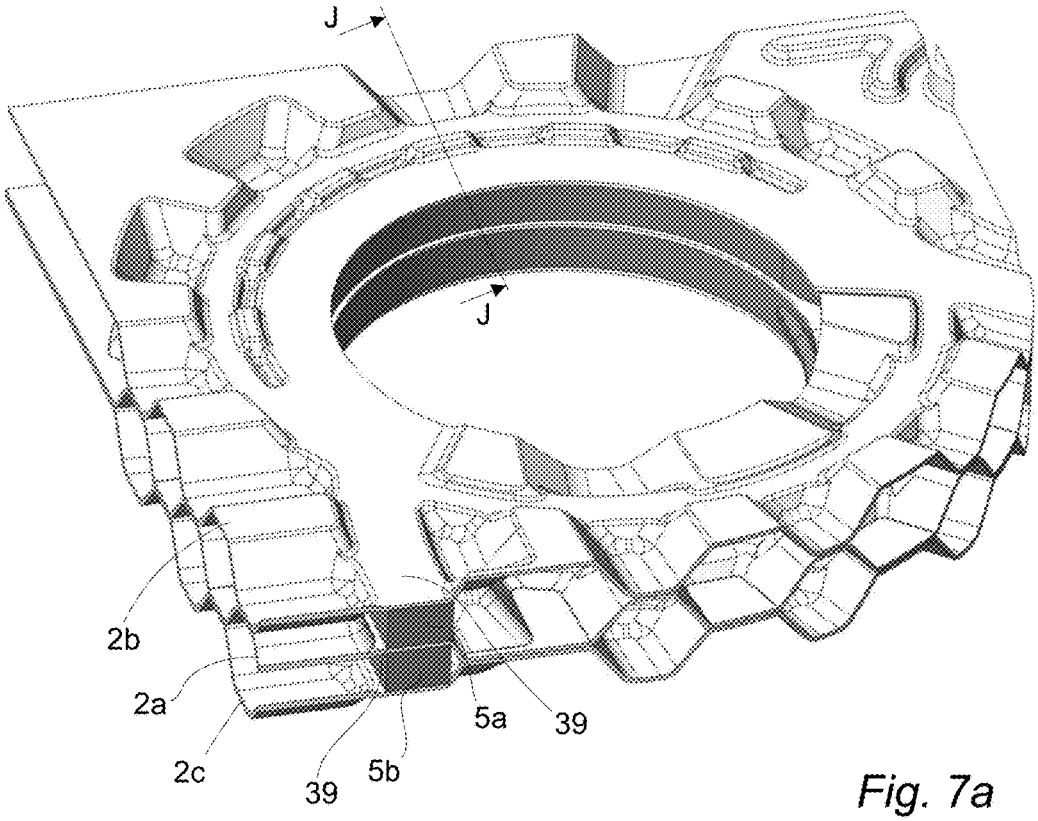
FIG. 7*a* is a schematic perspective view illustrating a part of the plate pack in FIG. 2, FIG. 7*b* schematically illustrates a sub-part of the plate pack part in FIG. 7*a* as viewed from inside portholes.
Figure 7B:
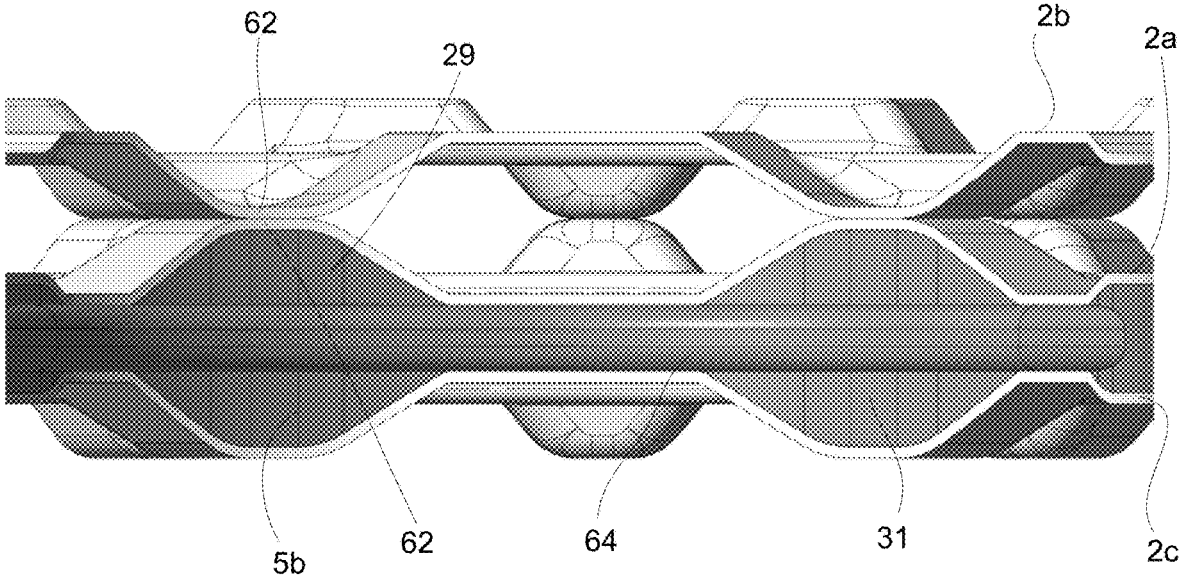
Figure 8A:
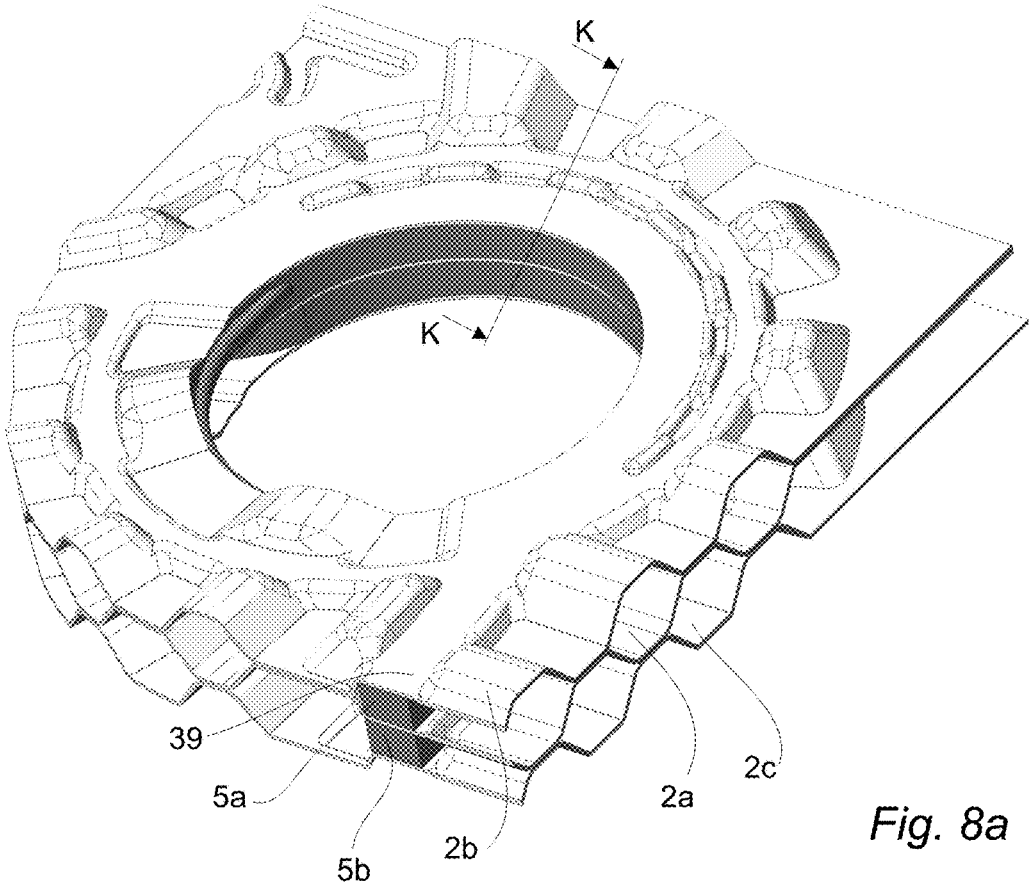
FIG. 8*a* is a schematic perspective view illustrating another part of the plate pack in FIG. 2, FIG. 8*b* schematically illustrates a sub-part of the plate pack part in FIG. 8*a* as viewed from inside portholes.

The heat transfer plate 2*a* is pressed, in a conventional manner, in a pressing tool, to be given a desired structure, more particularly different corrugation patterns within different portions of the heat transfer plate. The corrugation patterns are optimized for the specific functions of the respective plate portions. Accordingly, the heat transfer plate 2*a* comprises two distribution areas 28 which each is provided with a distribution pattern adapted for optimized fluid distribution across the heat transfer plate. Further, the heat transfer plate 2*a* comprises a heat transfer area 30 arranged between the distribution areas 28 and provided with a heat transfer pattern adapted for optimized heat transfer between two fluids flowing on opposite sides of the heat transfer plate. Moreover, the heat transfer plate 2*a* comprises an outer edge portion 32 extending along an outer edge 34 of the heat transfer plate 2*a*. The outer edge portion 32 comprises corrugations 36 which make the outer edge portion stiffer and, thus, the heat transfer plate 2*a* more resistant to deformation. Further, the corrugations 36 form a support structure in that they are arranged to abut corrugations of the adjacent heat transfer plates in the plate pack of the PHE. Depending on the design of the distribution and heat transfer patterns, the heat transfer plate 2*a* may or may not be arranged to abut the adjacent heat transfer plates also within the distribution and heat transfer areas 28 and 30, respectively. However, this is not further discussed herein. Also, the heat transfer plate 2*a* comprises, as seen from the front side 4, a front gasket groove 27 and, as seen from the back side 6, a back gasket groove 39 (not visible in FIG. 1 but indicated in FIGS. 7*a* and 8*a*). The front and back gasket grooves are partly aligned with each other and arranged to receive a respective gasket.

Figure 2:
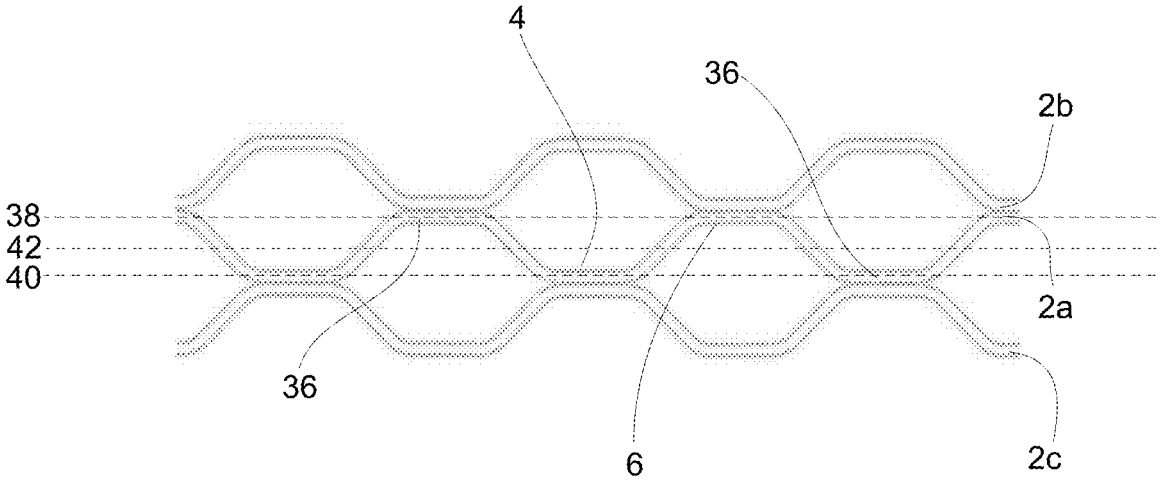
FIG. 2 illustrates abutting outer edges of adjacent heat transfer plates in a plate pack, as seen from the outside of the plate pack.

With reference to FIG. 2, illustrating the contact between the heat transfer plate 2*a* and two adjacent heat transfer plates 2*b* and 2*c* of the plate pack, the corrugations 36 extend between and in a first plane 38 and a second plane 40, which are parallel to the figure plane of FIG. 1. An intermediate plane 42 extends half way between the first and second planes 38 and 40, and a respective bottom of the front and back gasket grooves 27 and 39 extends in this intermediate plane 42, i.e. in so called half plane.

With reference again to FIG. 1, the first, second, third and fourth plate areas 20, 22, 24 and 26 each comprises a port hole area. The port hole areas have two different configurations, a first port hole area 44 having a first configuration and a second port hole area 46 having a second configuration. Each of the first and third plate areas 20 and 24 comprises a first port hole area 44, and each of the second and fourth plate areas 22 and 26 comprises a second port hole area 46.

The first port hole area 44 of the first plate area 20 will now be described in further detail with reference to FIGS. 3*a*-3*e*. It comprises a first port hole 48 defined by an annular first inner edge 50 of the heat transfer plate 2*a*. The first inner edge 50 consists of an "outer" first section 52 and an "inner" second section 54, the borders between the first and second sections being illustrated by the dashed straight lines in FIG. 3*a*. As is clear from FIG. 3*a*, the first section 52 constitutes about 50% of the first inner edge 50 and extends between the long and short sides 8 and 12, respectively, and the first port hole 48, of the heat transfer plate 2*a*. Further, the first port hole area 44 comprises an annular first inner port portion 56 extending along the first and second sections 52 and 54 of the first inner edge 50, an annular first intermediate port portion 58 encircling the first inner port portion 56 and an annular first outer port portion 60 encircling the first intermediate port portion 58. The borders between the first inner, intermediate and outer port portions 56, 58 and 60 are illustrated by the dashed circles in FIG. 3*a*, the first inner port portion 56 extending from the first inner edge 50 to the innermost dashed circle. Along the first section 52 of the first inner edge 50, the first inner port portion 56 is plane and extends in the intermediate plane 42 (illustrated in FIGS. 2 and 3*c*). The front and back gasket grooves 27 and 39 (FIGS. 7*a* and 8*a*) extend within the first inner, intermediate and outer port portions 56, 58 and 60, respectively.

The first inner port portion 56 comprises, as seen from the front side 4 of the heat transfer plate 2*a*, two first support projections 62, separately arranged along the second section 54 of the first inner edge 50. As is clear from FIG. 3*c*, which illustrates the first port hole area 44 along the second section 54 of the first inner edge 50 as viewed from inside the first port hole 48, each of the first support projections 62 comprises a first top portion 64 extending in the first plane 38. As is clear from FIG. 3*a*, the first support projections 62 are arranged at the very first inner edge 50 of the heat transfer plate such that the first top portions 64 extend there from.

Only the first support projections 62 of the first inner port portion 56 are, as will be further discussed below, arranged to contact adjacent heat transfer plates in a plate pack. Thus, the complete first inner port portion 56, outside the first support projections 62, extend at a distance ≠0 from the first and second planes 38 and 40, respectively. As is clear from FIGS. 3*b* and 3*c*, between the first support projections 62, and at locations X on a respective outside of the first support projections 62, the first inner port portion 56 deviates from the intermediate plane 42, so as to extend in a third plane 66 arranged between the intermediate plane and the second plane 40, to strengthen the first inner port portion.

Figure 3A:
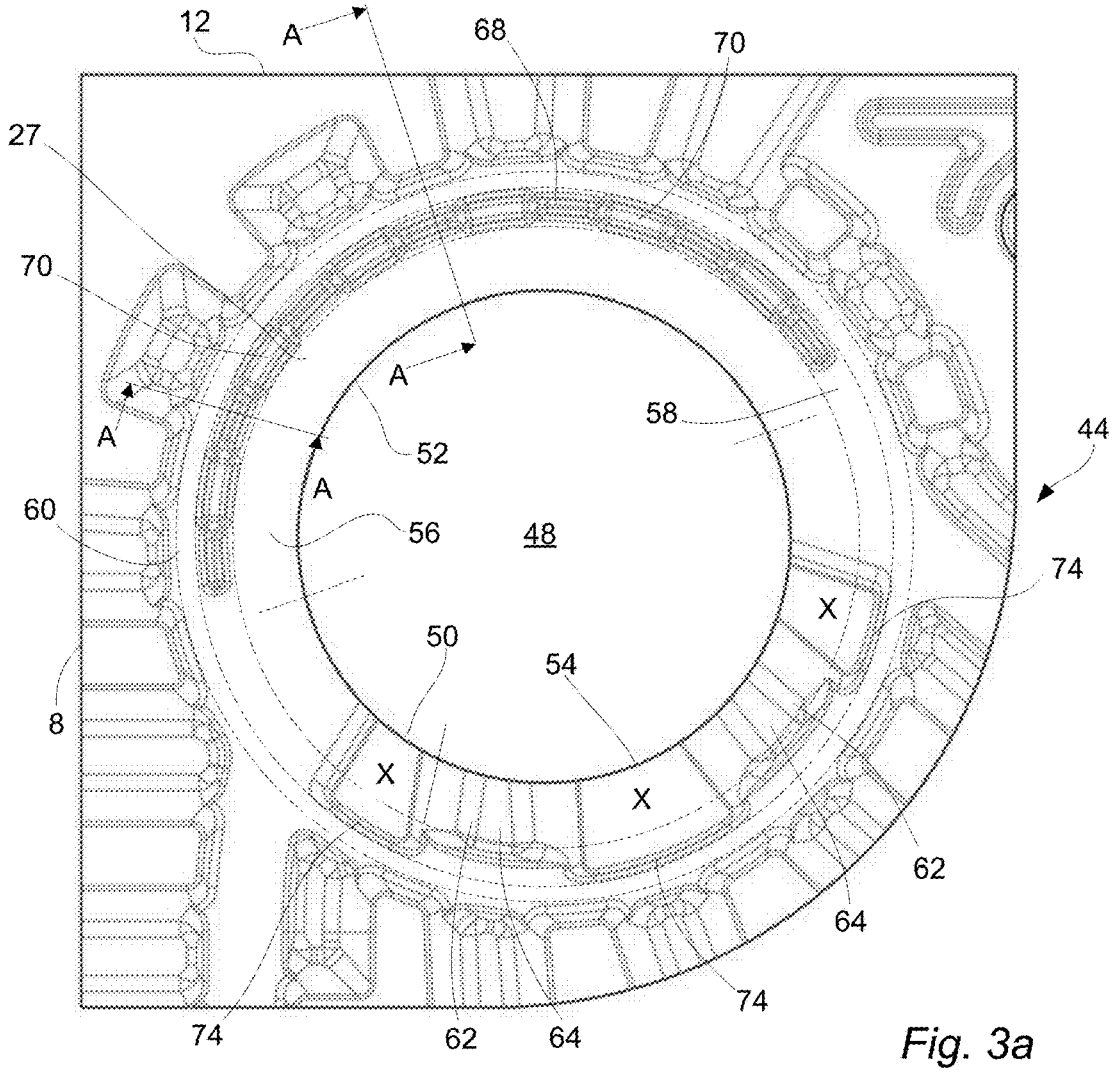
FIG. 3*a* is schematic plan view of a first port hole area of the plate in FIG. 1.
Figure 3B:
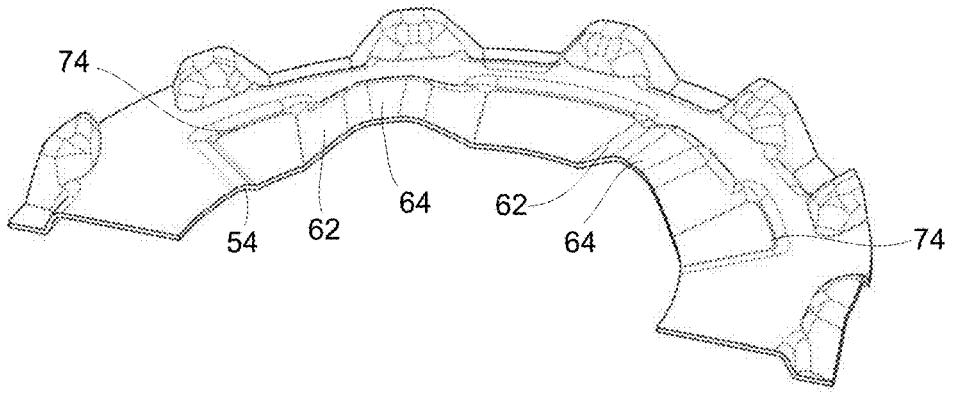
FIG. 3*b* is a schematic perspective view of a first portion of the first port hole area in FIG. 3*a*.
Figure 3C:
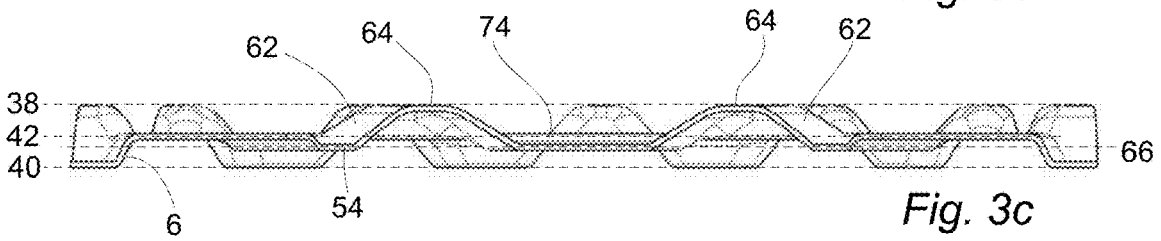
FIG. 3*c* is a schematic view of the first portion of the first port hole area in FIG. 3*b*, seen from inside a first port hole.
Figure 3D:
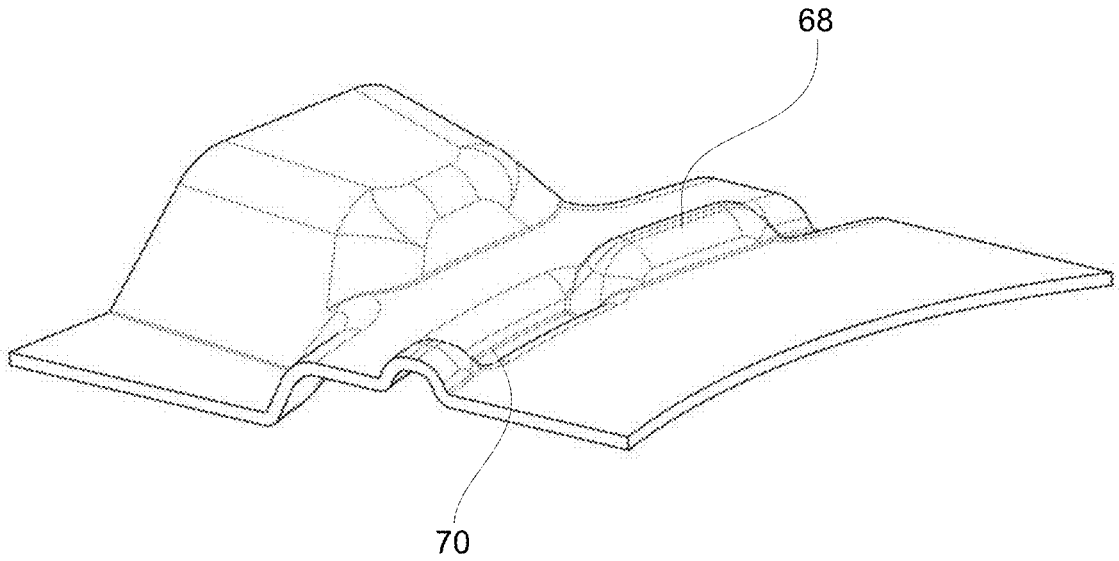
FIG. 3*d* is a schematic perspective view of a second portion of the first port hole area in FIG. 3*a*, FIG. 3*e* schematically illustrates the second portion of the first port hole area in FIG. 3*d* seen from the side, and a cross section of the first port hole area taken at A-A in FIG. 3*a*.
Figure 3E:
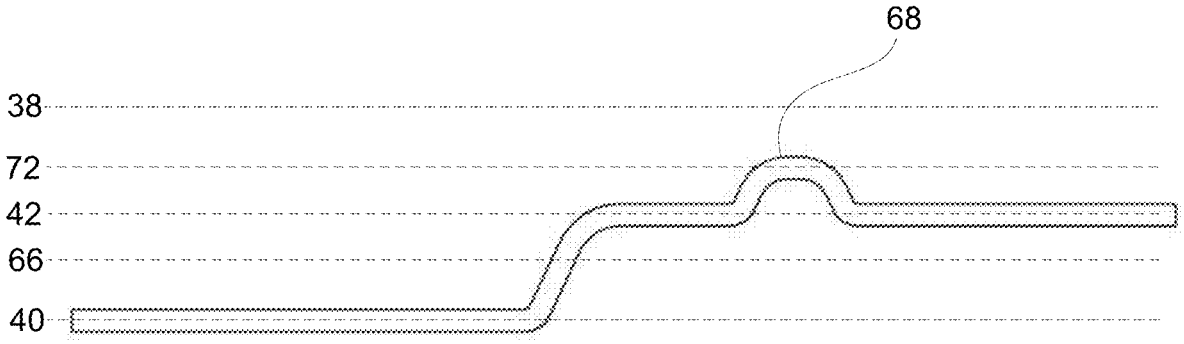

The first intermediate port portion 58 comprises, as seen from the front side 4 of the heat transfer plate 2*a*, a plurality of positioning projections 68 and a plurality of positioning recesses 70, which are alternately arranged, along the first section 52 of the first inner edge 50 of the heat transfer plate 2*a*. As is illustrated in FIGS. 3*a*, 3*d* and 3*e*, the positioning projections 68 are elongate ridges curved so as to follow the first inner edge 50 and extending from the intermediate plane 42 to a fourth plane 72 arranged between the intermediate plane and the first plane 38. Similarly, the positioning recesses 70 are elongate valleys curved so as to follow the first inner edge 50 and extending from the intermediate plane 42 to the third plane 66 arranged between the intermediate plane and the second plane 40. The third and fourth planes 66 and 72 are arranged on the same distance from the intermediate plane 42.

Further, the first intermediate port portion 58 further comprises, as seen from the front side 4 of the heat transfer plate 2*a*, a plurality of positioning recesses 74 along the second section 54 of the first inner edge 50 of the heat transfer plate 2*a*. As is illustrated in FIGS. 3*a*, 3*b* and 3*c*, the positioning recesses 74 extend from the intermediate plane 42 to the third plane 66 and a respective bottom of the positioning recesses 74 pass, at the locations X, into the first inner port portion 56 flush therewith.

The first outer port portion 60 is plane and extends in the intermediate plane 42.

The above description is valid also for the first port hole area 44 of the third plate area 24 except that the first section of the first inner edge thereof extends between the long and short sides 8 and 14, respectively, and the first port hole thereof.

The second port hole area 46 of the second plate area 22 will now be described in further detail with reference to FIGS. 4*a*-4*e*. It comprises a second port hole 76 defined by an annular second inner edge 78 of the heat transfer plate 2*a*. The second inner edge 78 consists of an "outer" first section 80 and an "inner" second section 82, the borders between the first and second sections being illustrated by the dashed straight lines in FIG. 4*a*. As is clear from FIG. 4*a*, the first section 80 constitutes about 50% of the second inner edge 78 and extends between the long and short sides 10 and 12, respectively, and the second port hole 76, of the heat transfer plate 2*a*. Further, the second port hole area 46 comprises an annular second inner port portion 84 extending along the first and second sections 80 and 82 of the second inner edge 78, an annular second intermediate port portion 86 encircling the second inner port portion 84 and an annular second outer port portion 88 encircling the second intermediate port portion 86. The borders between the second inner, intermediate and outer port portions 84, 86 and 88 are illustrated by the dashed circles in FIG. 4*a*, the second inner port portion 84 extending from the second inner edge 78 to the innermost dashed circle. Along the first section 80 of the first inner edge 78, the second inner port portion 84 is plane and extends in the intermediate plane 42 (illustrated in FIGS. 2 and 4*c*). The front and back gasket grooves 27 and 39 (FIGS. 7*a* and 8*a*) extend within the first inner, intermediate and outer port portions 84, 86 and 88, respectively.

The second inner port portion 84 comprises, as seen from the back side 6 of the heat transfer plate 2*a*, two second support projections 90, separately arranged along the second section 82 of the second inner edge 78. As is clear from FIG. 4*c*, which illustrates the second port hole area 46 along the second section 82 of the second inner edge 78 as viewed from inside the second port hole 76, each of the second support projections 90 comprises a second top portion 92 extending in the second plane 40. As is clear from FIG. 4*a*, the second support projections 90 are arranged at the very second inner edge 78 of the heat transfer plate such that the second top portions 92 extend there from.

Only the second support projections 90 of the second inner port portion 84 are, as will be further discussed below, arranged to contact adjacent heat transfer plates in a plate pack. Thus, the complete second inner port portion 84, outside the second support projections 90, extend at a distance ≠0 from the first and second planes 38 and 40, respectively. As is clear from FIGS. 4*b* and 4*c*, between the second support projections 90, and at locations Y on a respective outside of the second support projections 90, the second inner port portion 84 deviates from the intermediate plane 42, so as to extend in the fourth plane 72 arranged between the intermediate plane and the first plane 38, to strengthen the second inner port portion.

Figure 4A:
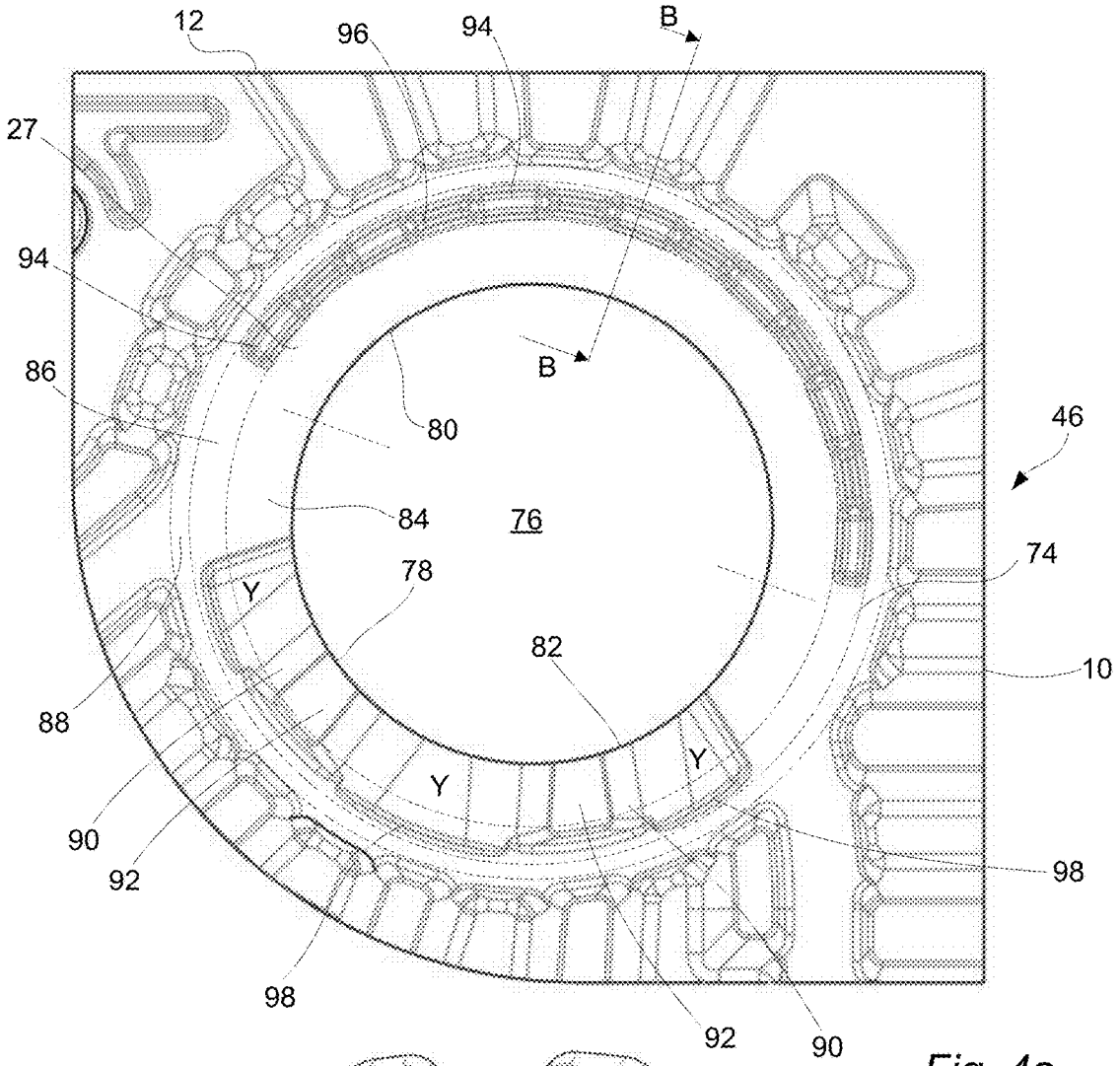
FIG. 4*a* is schematic plan view of a second port hole area of the plate in FIG. 1.
Figure 4B:
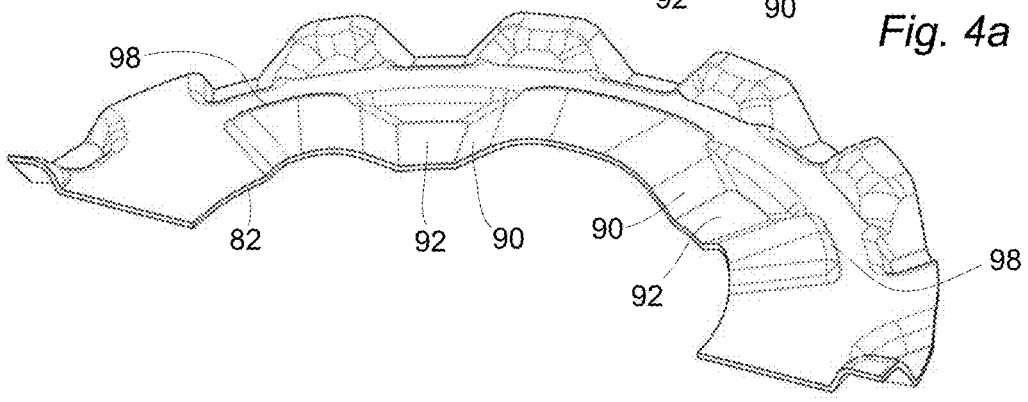
FIG. 4*b* is a schematic perspective view of a first portion of the second port hole area in FIG. 4*a*.
Figure 4C:
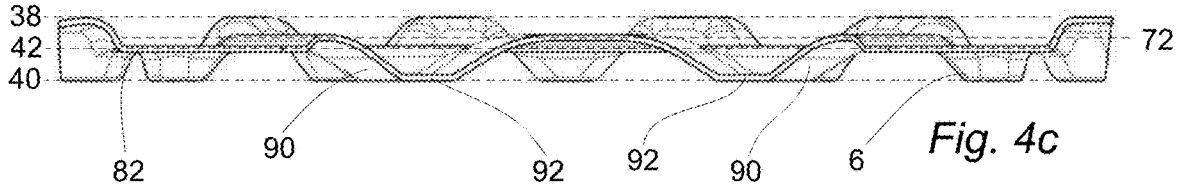
FIG. 4*c* is a schematic view of the first portion of the second port hole area in FIG. 4*b*, seen from inside a second port hole.
Figure 4D:
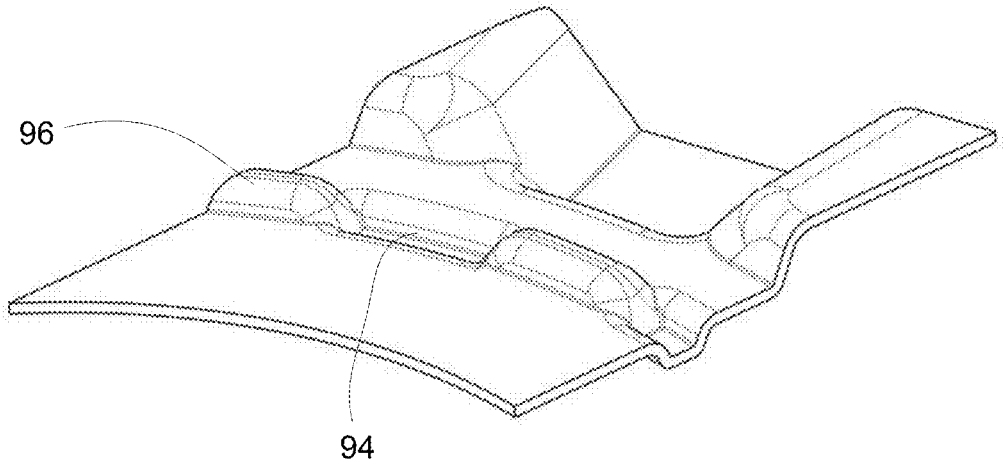
FIG. 4*d* is a schematic perspective view of a second portion of the second port hole area in FIG. 4*a*, FIG. 4*e* schematically illustrates the second portion of the second port hole area in FIG. 4*d* seen from the side, and a cross section of the second port hole area taken at B-B in FIG. 4*a*.
Figure 4E:
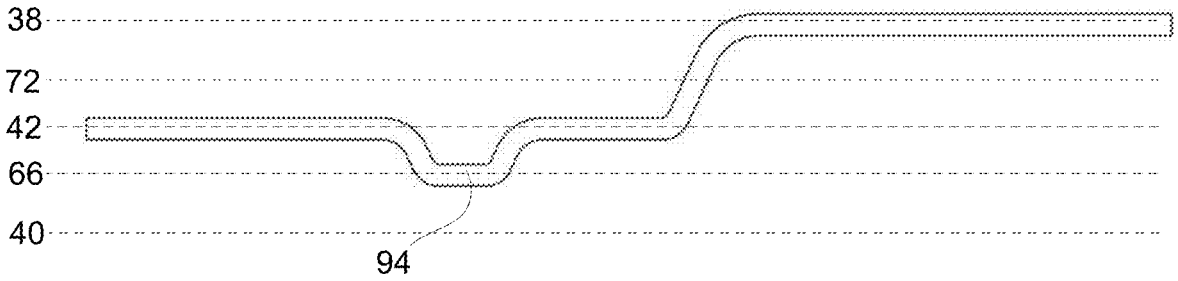

The second intermediate port portion 86 comprises, as seen from the back side 6 of the heat transfer plate 2*a*, a plurality of positioning projections 94 and a plurality of positioning recesses 96, which are alternately arranged, along the second section 80 of the second inner edge 78 of the heat transfer plate 2*a*. As is illustrated in FIGS. 4*a*, 4*d* and 4*e*, the positioning projections 94 are elongate ridges curved so as to follow the second inner edge 78 and extending from the intermediate plane 42 to the third plane 66 arranged between the intermediate plane and the second plane 40. Similarly, the positioning recesses 96 are elongate valleys curved so as to follow second inner edge 78 and extending from the intermediate plane 42 to the fourth plane 72 arranged between the intermediate plane and the first plane 38.

Further, the second intermediate port portion 86 further comprises, as seen from the back side 6 of the heat transfer plate 2*a*, a plurality of positioning recesses 98 along the second section 82 of the second inner edge 78 of the heat transfer plate 2*a*. As is illustrated in FIGS. 4*a*, 4*b* and 4*c*, the positioning recesses 98 extend from the intermediate plane 42 to the fourth plane 72 and a respective bottom of the positioning recesses 98 pass, at the locations Y, into the second inner port portion 84 flush therewith.

The second outer port portion 88 is plane and extends in the intermediate plane 42.

The above description is valid also for the second port hole area 46 of the fourth plate area 26 except that the first section of the second inner edge thereof extends between the long and short sides 10 and 14, respectively, and the second port hole thereof.

As is clear from FIG. 1, the four port holes 48 and 76 are arranged at a respective one of four corners of the heat transfer plate 2*a*, and the first and second porthole areas 44 and 46 are symmetrically arranged with reference to the transverse and longitudinal centre axes 18 and 16, respectively. The first port hole area 44 of the first plate area 20 is a mirroring, in the transverse centre axis 18, of the first port hole area 44 of the third plate area 24, and an "inversion", in the longitudinal centre axis 16, of the second port hole area 46 of the second plate area 22. In a corresponding way, the port hole areas 46 of the second and fourth plate areas 22 and 26 are mirror images of each other, and the port hole area 46 of the fourth plate area 26 and the first port hole area 44 of the third plate area 24 are "inversions" of each other.

Figure 5:
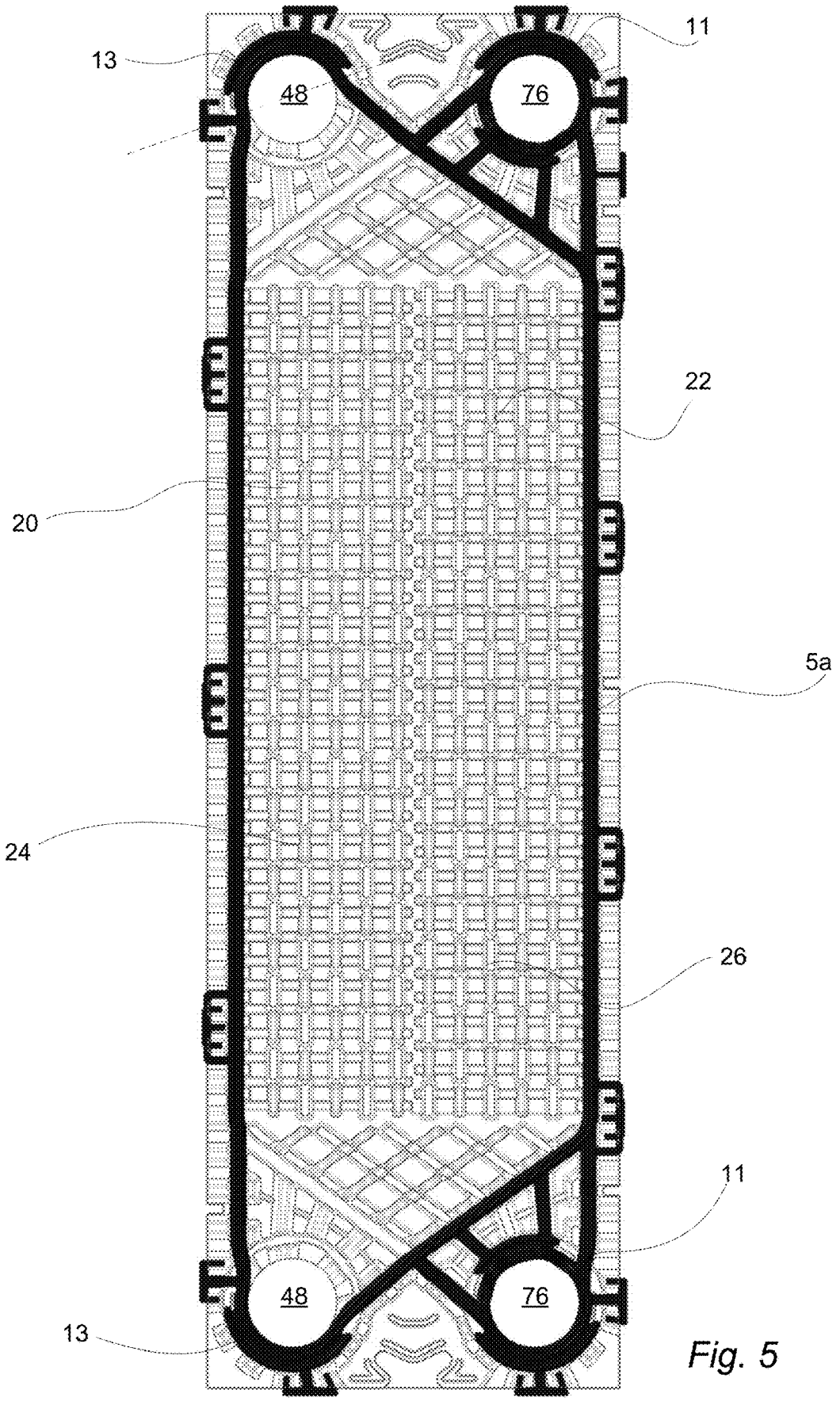
FIG. 5 is a schematic plan view of the heat transfer plate in FIG. 1 provided with a gasket.

As previously said, heat transfer plates of the kind described above are arranged to be aligned, with one gasket 5 between each two adjacent heat transfer plates, to form a plate pack. FIG. 5 illustrates such a gasket 5*a* provided in the front gasket groove 27 (FIG. 1) of the above describe heat transfer plate 2*a*. The gasket 5*a* is illustrated in further detail in FIGS. 6*a-f*. It comprises a front side 7, an opposing back side 9 and two annular gasket parts 11 (FIG. 5). The annular gasket parts 11 are arranged to encircle a respective one of the portholes within the second and fourth plate areas 22 and 26, respectively, of the heat transfer plate 2*a*. The gasket 5*a* further comprises two semi-annular gasket parts 13 (FIG. 5) arranged to just partly encircle a respective one of the portholes, more particularly extend along only the first section 52 of the first inner edge 50 (FIG. 3*a*) thereof, within the first and third plate areas 20 and 24, respectively, of the heat transfer plate 2*a*. The annular and semi-annular gasket parts 11, 13 are illustrated in more detail in FIGS. 6*a* and 6*b*, respectively. The annular gasket parts 11 are similar. Hereinafter, one of them will be described with reference to FIGS. 6*a* and 6*c*-6*f*. It comprises an inner edge 15 consisting of an "outer" first section 17 and an "inner" second section 19, the borders between the first and second sections being illustrated by the dashed straight lines in FIG. 6*a*. As is clear from FIG. 6*a*, the first section 17 constitutes about 50% of the inner edge 15. Further, the annular gasket part 11 comprises an annular inner gasket portion 21, in turn, comprising the inner edge 15, an intermediate gasket portion 23 partly encircling the inner gasket portion 21 and an outer gasket portion 25 encircling the intermediate gasket portion 23. The intermediate and outer gasket portions 23 and 25 are, as is clear from FIG. 6*a*, discontinuous. The borders between the inner, intermediate and outer gasket portions 21, 23 and 25 are illustrated by the dashed circles in FIG. 6*a*, the inner gasket portion 21 extending from the inner edge 15 to the innermost dashed circle, and by the vertical dashed straight lines in FIGS. 6*c*-6*e*.

Figure 6A:
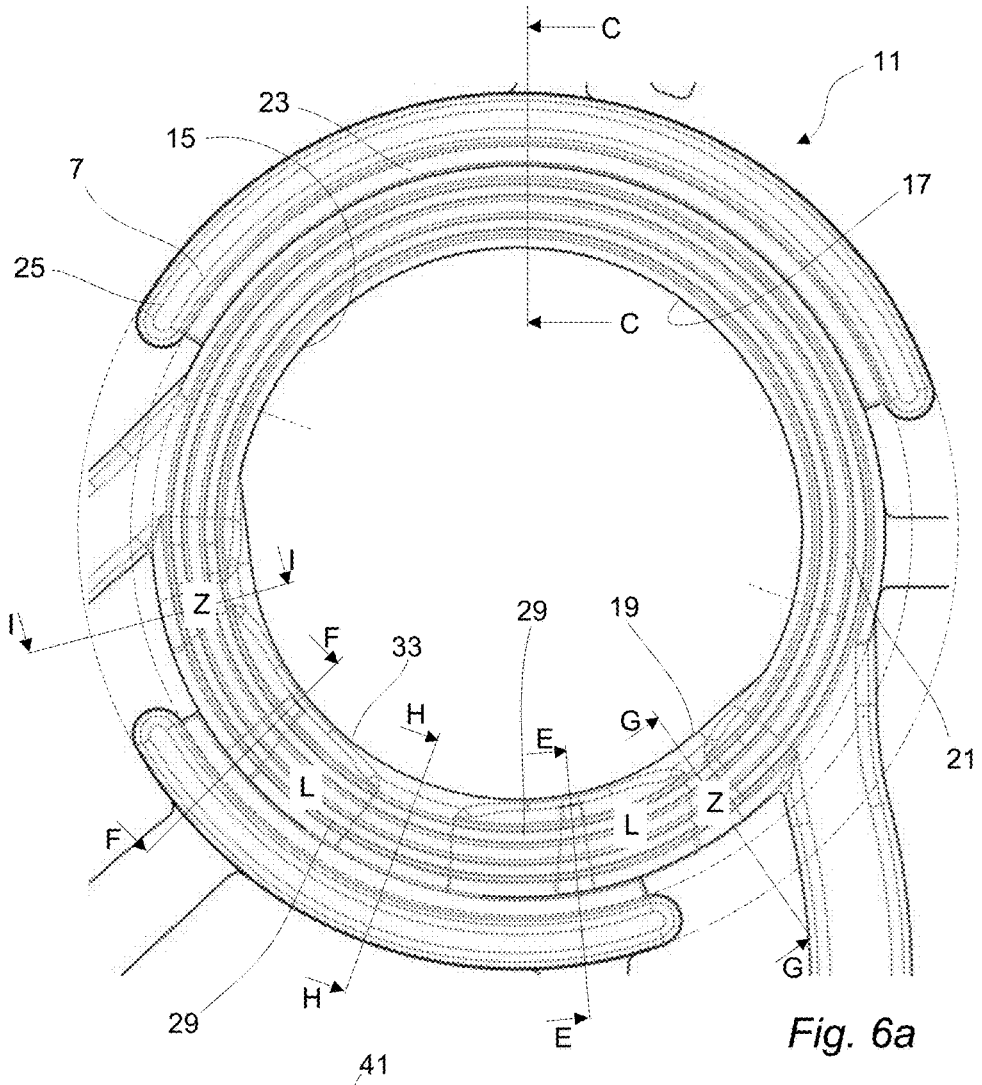
FIG. 6*a* is an annular gasket part, in an unloaded condition, of the gasket in FIG. 5.
Figure 6B:
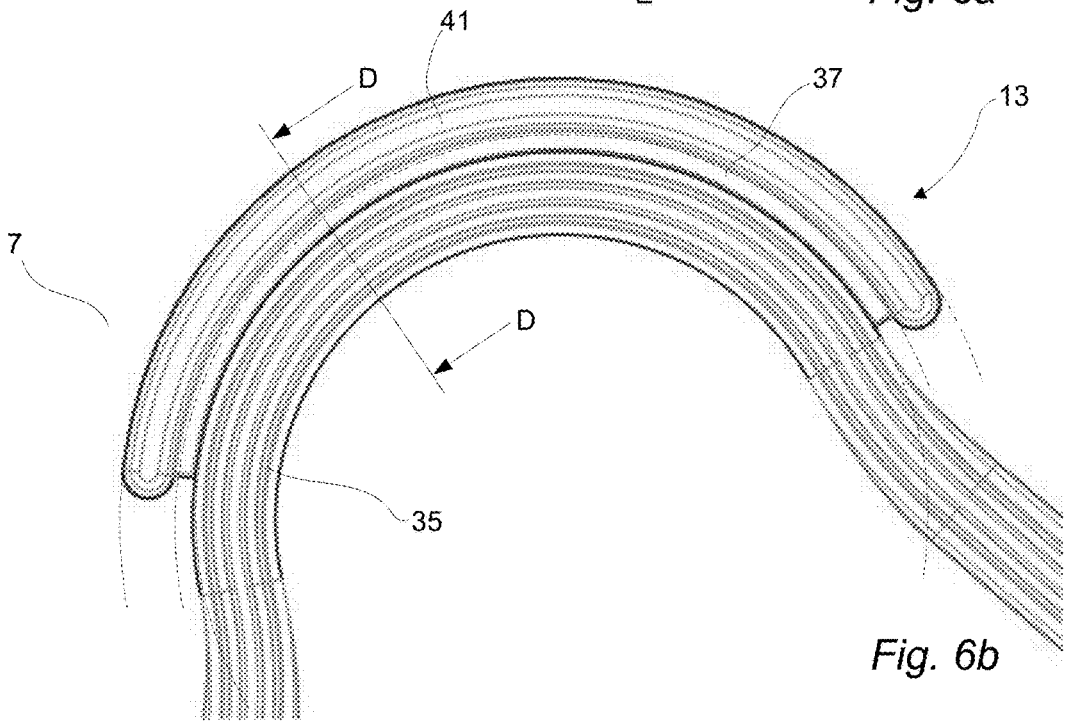
FIG. 6*b* is a semi-annular gasket part, in an unloaded condition, of the gasket in FIG. 5.
Figure 6C:
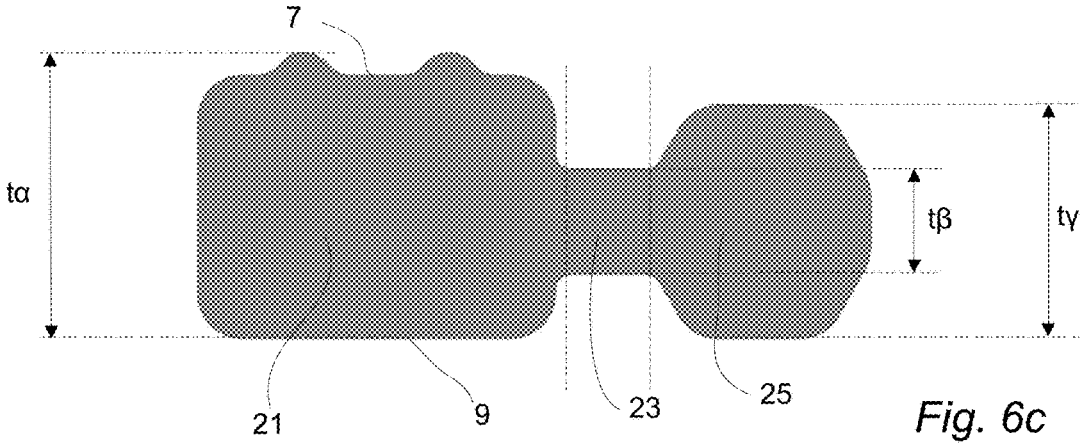
FIG. 6*c* is a schematic cross section of the annular gasket part in FIG. 6*a*, taken at C-C, and of the semi-annular gasket part in FIG. 6*b*, taken at D-D.
Figure 6D:
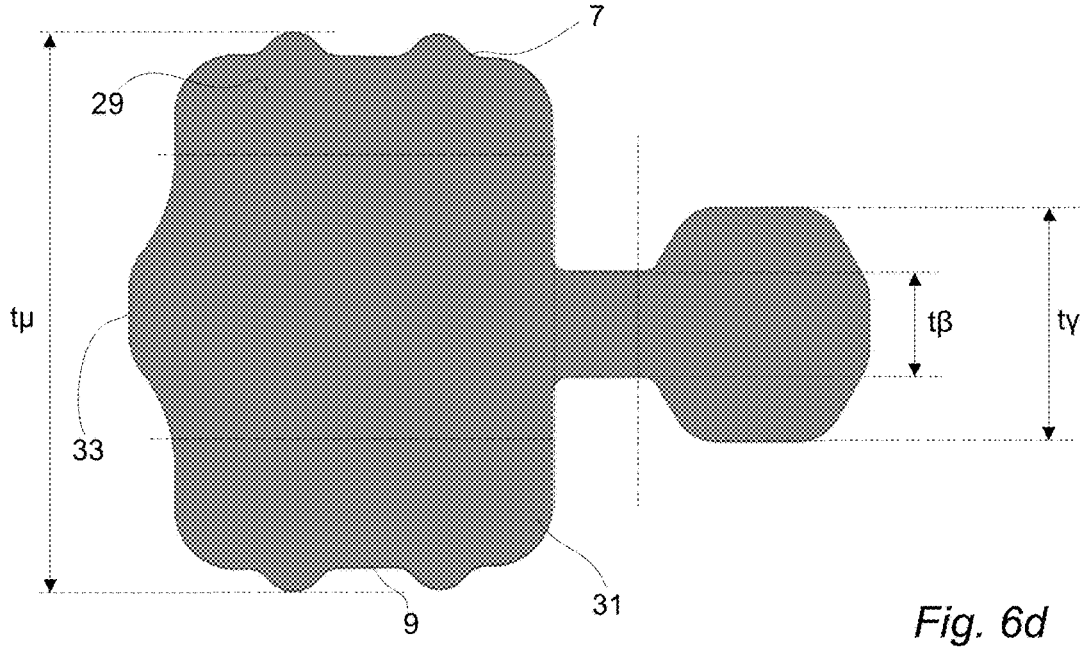
FIG. 6*d* is a schematic cross section of the annular gasket part in FIG. 6*a*, taken along lines E-E and F-F.
Figure 6E:
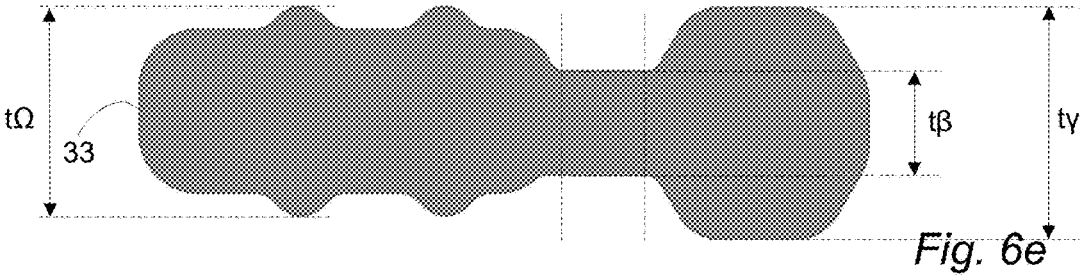
FIG. 6*e* is a schematic cross section of the annular gasket part in FIG. 6*a*, taken at H-H, FIG. 6*f* schematically illustrates a portion of the annular gasket part in FIG. 6*a* as seen from an area encircled by the annular gasket part.

The cross section of the annular gasket part 11 along the first section 17 of the inner edge 15 and along the intermediate gasket portion 23 is essentially constant and illustrated in FIG. 6*c*. Along the first section 17 of the inner edge 15, the inner gasket portion 21 and the annular gasket part 11 has a maximum thickness ta, the intermediate gasket portion 23 has a maximum thickness tβ and the outer gasket portion 25 has a maximum thickness tγ, tα>tγ>tβ. The cross section of the annular gasket part 11 along the second section 19 of the inner edge 15 varies, FIG. 6*d* illustrating the cross section at E-E and F-F in FIG. 6*a*, and FIG. 6*e* illustrating the cross section at H-H in FIG. 6*a*. The left side of FIG. 6*e*, i.e. the cross section of the inner gasket portion 21, also illustrates the cross section at I-I and G-G in FIG. 6*a*.

Figure 6F:
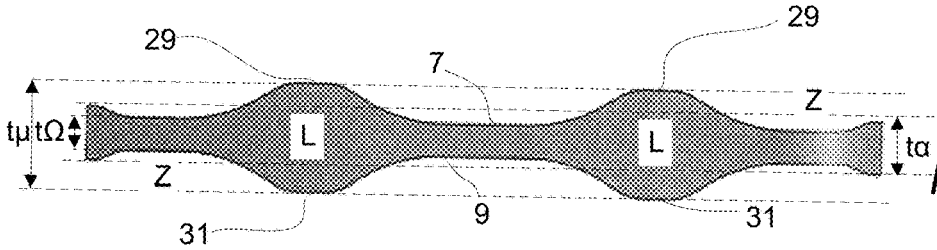

As is clear from FIGS. 6*a* and 6*d*, and FIG. 6*f* which illustrates the annular gasket part along the second section 19 of the inner edge 15, at each of two separated locations L along the second section 19 of the inner edge 15, the inner gasket portion 21 comprises two aligned projections 29, 31 projecting from the opposing front and back sides 7 and 9, respectively, of the gasket 5*a*, so as to give the inner gasket portion 21 a locally increased thickness >tα. Between the projections 29, 31, and at locations Z on a respective outside of the projections 29, 31, the maximum thickness of the inner gasket portion 21 is locally decreased so as to be <tα. As is clear from FIGS. 6*d* and 6*f*, within the projections 29, 31, the maximum thickness of the inner gasket portion 21 varies along the second section 19 of the inner edge 15 so as to be the largest, tμ, at the centres of the projections and the smallest, tππ, at the very borders of the projections, tππ being just slightly larger than tα. Thus, the borders of the projections 29, 31 are defined by the maximum thickness of the inner gasket portion 21 exceeding tα. The intermediate gasket portion 23 has a maximum thickness tβ and the outer gasket portion 25 has a maximum thickness tγ, tμ>tππ>tα>tγ>tβ. As is clear from FIGS. 6*e* and 6*f*, at G-G, H-H and I-I in FIG. 6*a*, where the inner gasket portion 21 is the thinnest, the inner gasket portion 21 and the annular gasket part 11 has a maximum thickness tn. Further, at H-H in FIG. 6*a*, the intermediate gasket portion 23 has a maximum thickness tβ and the outer gasket portion 25 has a maximum thickness tγ, tα>tγ>tΩ>tβ.

Thus, the inner gasket portion 21 has a maximum thickness t1 along the complete inner edge 15 except for at the projections 29, 31, and t1 is varying between tΩ and tα. Further, the inner gasket portion 21 has a maximum thickness t2 within the projections 29, 31, and t2 is varying between tππ and tμ, t2>t1. The outer gasket portion 25 has a constant cross section, and thus a constant maximum thickness t3=tγ, along essentially its entire extension. Similarly, the intermediate gasket portion 23 has a constant cross section, and thus a constant maximum thickness tβ<t3, along essentially its entire extension.

As is illustrated in FIGS. 6*a*, 6*d* and 6*e*, an inner surface 33 of the inner gasket portion 21 extending between the front and back sides 7, 9 of the gasket 5*a* is convex or outwards bulging along at least a part of the second section 19 of the inner edge 15.

The semi-annular gasket parts 13 of the gasket 5*a* are similar. Hereinafter, one of them will be described with reference to FIGS. 6*b* and 6*c*. As illustrated in FIG. 6*b*, the semi-annular gasket part 13 comprises a semi-annular inner gasket portion 35, a semi-annular intermediate gasket portion 37 and a semi-annular outer gasket portion 41, which gasket portions extend along each other with the intermediate gasket portion arranged in the middle. The borders between the inner, intermediate and outer gasket portions 35, 37 and 41 are illustrated by the dashed semi-circles in FIG. 6*b*.

The cross section of the semi-annular gasket part 13 along the intermediate gasket part 41 is essentially constant and similar to the cross section of the annular gasket part 11 along the intermediate gasket part 23. It is therefore illustrated in FIG. 6*c* and not further discussed.

The cross section of the gasket 5*a* outside the annular and semi-annular gasket parts 11, 13 is essentially the same as the cross section of the inner gasket portion 35 of the semi-annular gasket part 13.

In the context of the following description, it is to be understood that the projections and recesses of a heat transfer plate as seen from the front side are recesses and projections, respectively, of the heat transfer plate as seen from the back side, and vice versa. Further, in the following description, "heat transfer plate" is also referred to as just "plate".

Figure 8B:
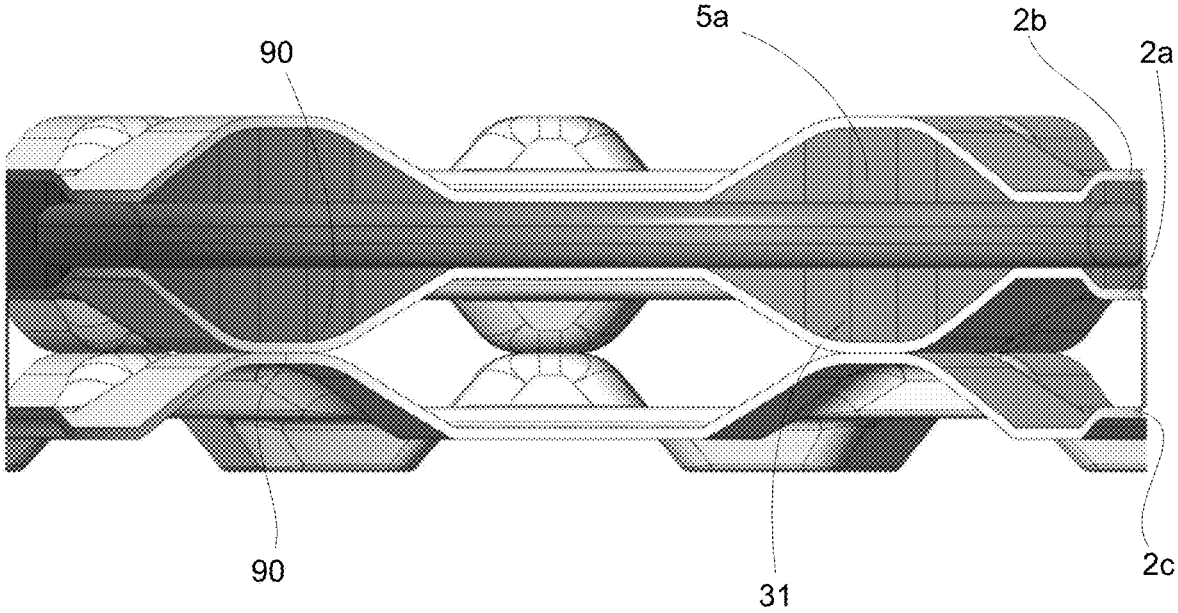
Figure 9:
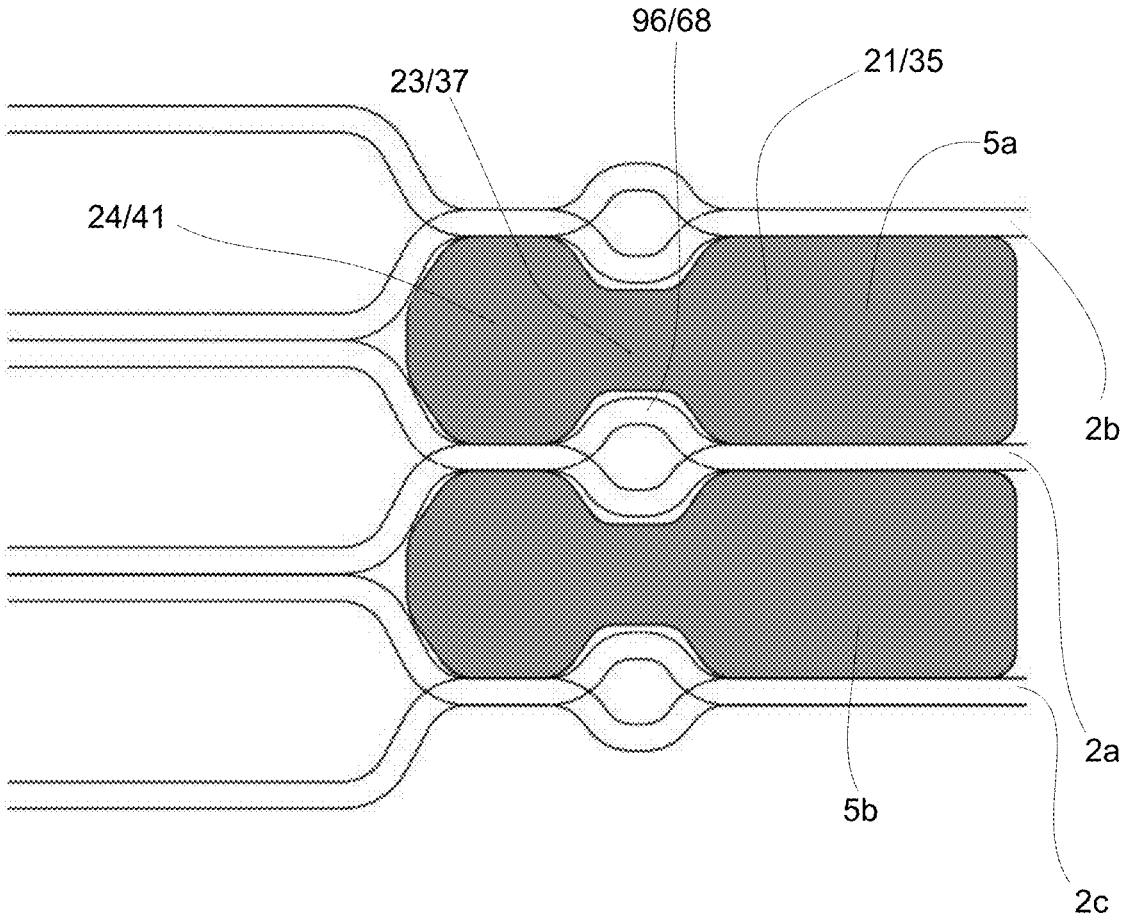
FIG. 9 is a schematic cross section of the plate pack parts in FIGS. 7*a* and 8*a* taken at J-J and K-K, respectively.

With reference to FIGS. 7*a*, 7*b*, 8*a*, 8*b* and 9, in the plate pack illustrated partly in FIG. 2, the gasket 5*a* is arranged on the plate 2*a* as illustrated in FIG. 5, with the back side 9 of the gasket 5*a* contacting a bottom of the front gasket groove 27 of the plate 2*a*. (The gasket 5*a* is provided with outwards projecting fastening means, which in FIG. 5 have not yet been properly arranged around the plate edge). The annular gasket parts 11 of the gasket 5*a* are arranged around a respective one of the second port holes 76 of the plate 2*a* in such a way that (FIGS. 4*a* and 6*a*) the first sections 17 of the inner edges 15 of the annular gasket parts 11 extend along the first sections 80 of the second inner edges 78 of the plate 2*a*. Similarly, the second sections 19 of the inner edges 15 of the annular gasket parts 11 extend along the second sections 82 of the second inner edges 78 of the plate 2*a*. Then, since the designs and measures of the plate 2*a* and the gasket 5*a* are adapted to each other, the second inner, intermediate and outer port portions 84, 86 and 88 of the plate 2*a* will be aligned with the inner, intermediate and outer gasket portions 21, 23 and 25, respectively, of the gasket 5*a*. Further, projections and recesses of the plate 2*a*, as seen from the front side thereof, will engage with recesses and projections, respectively, of the gasket 5*a*, as seen from the back side 9 thereof. For example, as is illustrated in FIG. 8*b*, which shows the second sections 82 of the second inner plate edges 78 and one of the annular gasket portions 11 along the second section 19 of the inner edge 15, the projections 31 of the annular gasket parts 11 will be received in a respective one of the recesses formed by the second support projections 90 of the plate 2*a*. Further, as is illustrated in FIG. 9, the projections formed by the positioning recesses 96 of the plate 2*a* will be received in the grooves formed in the back side 9 of the annular gasket parts 11 between the inner and outer gasket portions 21 and 25 by the relatively small thickness of the intermediate gasket portions 23.

Further, the semi-annular gasket parts 13 of the gasket 5*a* are arranged around a respective one of the first port holes 48 of the plate 2*a* so as to extend along the first sections 52 of the first inner edges 50 of the plate 2*a* (FIGS. 3*a* and 6*b*). Then, the first inner, intermediate and outer port portions 56, 58 and 60 of the plate 2*a* will be aligned with the inner, intermediate and outer gasket portions 35, 37 and 41, respectively, of the gasket 5*a*. The positioning projections 68 of the plate 2*a* will be received in the grooves formed in the back side 9 of the semi-annular gasket parts 13 between the inner and outer gasket portions 35 and 41 by the relatively small thickness of the intermediate gasket portions 37.

The plate 2*b* is arranged on top of the gasket 5*a*, "flipped" in relation to the heat transfer plate 2*a*, such that the front side 7 of the gasket 5*a* contacts the bottom of the front gasket groove 27 of the heat transfer plate 2*b*, and projections and recesses of the plate 2*b*, as seen from the front side thereof, engage with recesses and projections, respectively, of the gasket 5*a*, as seen from the front side 7 thereof. As is clear from FIG. 7*b*, which shows the second sections 54 of the second inner plate edges 50 and one of the annular gasket portions 11 along the second section 19 of the inner edge 15, the first support projections 62 of the plate 2*a* abut a respective one of the first support projections 62 of the plate 2*b*.

Another gasket 5*b* faces the back side 6 of the plate 2*a* with the front side 7 of the gasket 5*b* contacting a bottom of the back gasket groove 39 of the plate 2*a*. Further, the gasket 5*b* is so arranged that the annular gasket parts 11 of the gasket 5*b* are arranged around a respective one of the first port holes 48 of the plate 2*a* and the semi-annular gasket parts 13 of the gasket 5*b* are arranged around a respective one of the first port holes 76 of the plate 2*a*. Projections and recesses of the plate 2*a*, as seen from the back side thereof, engage with recesses and projections, respectively, of the gasket 5*b*, as seen from the front side 7 thereof.

The plate 2*c* faces the gasket 5*b* and it is "flipped" in relation to the plate 2*a*, such that the back side 9 of the gasket 5*b* contacts the bottom of the back gasket groove 39 of the heat transfer plate 2*c*, and projections and recesses of the plate 2*c*, as seen from the back side thereof, engage with recesses and projections, respectively, of the gasket 5*b*, as seen from the back side 9 thereof. As is clear from FIG. 8*b*, the second support projections 90 of the plate 2*a* abut a respective one of the second support projections 90 of the plate 2*c*.

FIGS. 7*a-b*, 8*a-b* and 9 illustrate the plate pack tightened between the end plates of the PHE, and the gaskets thereby deformed properly for sealing between the plates. As is clear from the above description of the plate pack and the figures, the plate 2*a*, within its first and second inner port portions 56, 84, is separated from the plates 2*b* and 2*c* except for at the first and second support projections 62, 90. The annular gasket parts 11 of the gaskets 5*a*, 5*b* fill out the space between the plates completely in the area of the first and second inner port portions 56, 84. The semi-annular gasket parts 13 of the gaskets 5*a*, 5*b* fill out the space between the plates completely in the area of the first and second inner port portions 56, 84 along the first sections 52, 80 of the first and second inner edges 50, 78 of the plates. Thereby, fibres and particles of fluids to be treated in the PHE do not easily get stuck when flowing through the PHE. To even further reduce the risk of fibres and particles getting stuck when flowing throw the PHE, the annular gasket portions are, as previously described, along at least part of their inner edges, outwards bulging. Further, the first and second support projections 62, 90 within the first and second inner port portions of the plates will create the necessary plate support to prevent deflection of the plates. The above described embodiment of the present invention should only be seen as an example. A person skilled in the art realizes that the embodiment discussed can be varied in a number of ways without deviating from the inventive conception.

The plates and gaskets in a plate pack need not be identical. The inventive plate and gasket can be combined with non-identical plates and gaskets as long as these have the features according to the independent claims. Further, the plates in a plate pack need not be alternately "flipped" in relation to each other but could instead be alternately "rotated" in relation to each other.

In the above described embodiment, the inner gasket portion of the annular gasket part has a varying cross-section while the intermediate and outer gasket parts have essentially uniform cross sections. One or both of the intermediate and outer gasket portions could also have a varying cross section. For example, the intermediate gasket portion could have a varying thickness so as not to define a continuous groove between the inner and outer gasket portion but rather a plurality of separated grooves matching the positioning projections and recesses of the heat transfer plate.

Gaskets of different cross sections are possible within the scope of the invention. The gasket illustrated in the figures is provided with beads on its front side and beads on its back side along part of its extension, to improve the sealing capacity of the gasket. These beads could be partly/completely omitted in alternative embodiments of the present invention.

In the above described embodiment, the annular gasket portions are arranged in one piece with the rest of the gasket. According to an alternative embodiment, the annular gasket portions could be formed as port gaskets separate from the rest of the gasket.

In the above described embodiment the annular and semi-annular gasket parts 11, 13 extend all the way to the first and second inner edges of the heat transfer plates. Alternatively, the annular and semi-annular gasket parts could extend within the first and second inner edges of the heat transfer plates.

The number of support projections and positioning projections and recesses need not be as in the described embodiment, but could be more or less. Further, the design of the support projections and positioning projections and recesses could be varied endlessly. Further, the support projections need not extend all the way to the plate inner edges.

The positioning projections and recesses could be positioned on a larger or smaller distance from the first and second inner edges of the heat transfer plate, and the gasket could be designed accordingly.

The above described gasket comprises annular and semi-annular gasket parts having inner gasket portions arranged to seal between two adjacent heat transfer plates, and outer gasket portions arranged to maintain the gasket correctly positioned between the plates. According to an alternative embodiment of the invention, the annular and semi-annular gasket parts have inner gasket portions arranged to fill out the space between the plates completely in the area of the first and second inner port portions, without being substantially deformed. Such inner gasket portions could be designed like the outer gasket portions of the above described annular and semi-annular gasket parts. Further, according to this alternative embodiment, the annular and semi-annular gasket parts have outer gasket portions arranged to be deformed so as to seal between the plates. Such outer gasket portions could be designed like the inner gasket portions of the above described annular and semi-annular gasket parts. Naturally, for such an alternative gasket, the heat transfer plate to be used with the gasket should be properly redesigned.

The first and second sections of the first and second inner edges of the plate, and the first and second sections of the inner edge of the annular gasket part, are defined by the design of the semi-annular gasket part, more particularly, how much of the portholes that the semi-annular gasket part is arranged to surround. This is illustrated by the straight, dashed line in FIG. 5 marking where the semi-annular gasket part leaves the plate inner edge, which determines the extensions of the first and second sections. Accordingly, different extensions of the first and second sections of the first and second inner edges of the plate, and the first and second sections of the inner edge of the annular gasket part, are possible.

Also, the inner, intermediate and outer port and gasket portions need not be of uniform width along their complete lengths.

Finally, according to an alternative embodiment of the present invention the first and second support projections of the heat transfer plate extend also through the first and second intermediate port portions and through the first and second outer port portions so as to connect to the ridges and valleys of the corrugation patterns of the heat transfer plate. Further, the heat transfer plate comprises no positioning projections and no positioning recesses. Instead, along the first sections of the first and second inner edges of the heat transfer plate, the first and second intermediate port portions extend flush with, i.e. in the same plane as, the first and second inner port portions and the first and second outer port portions. Further, along the first sections of the first and second inner edges of the heat transfer plate, the first and second inner port portions, the first and second intermediate port portions and the first and second outer port portions are not plane but instead corrugated, or undulated as seen from a respective center of the port holes, while still extending within, and not in or beyond, the first and second planes. The gasket according to this alternative embodiment has a design adapted to the heat transfer plate. Accordingly, the projections of the annular gasket parts, which project from the front and back sides of the gasket, extend also through the intermediate and outer gasket portions. Further, outside any beads, the inner, intermediate and outer gasket portions have essentially similar maximum thickness such that the intermediate gasket portions extend essentially flush with the inner and outer gasket portions. Accordingly, the intermediate gasket portions form no grooves between the inner and outer gasket portions. For accurate positioning and safe retention of the gasket, it could be provided with additional gasket fastening means similar to the ones illustrated in FIG. 5, and/or gasket fastening means of a different kind. For example, such gasket fastening means of a different kind could be projections extending outwardly from the annular and semi-annular gasket parts, which projections could have a thickness equal to, or slightly less than, the distance between two adjacent heat transfer plates at the locations of the projections. These projections could be arranged to abut opposing corrugations of the adjacent heat transfer plates so as to prevent that the gasket is sucked into the port holes. Further, along the semi-annular gasket parts, and the annular gasket parts along the first section of the respective inner edges thereof, the front and back sides of the gasket are undulated to make the gasket seal properly between two adjacent heat transfer plates.

It should be stressed that the attributes first, second, third, etc. is used herein just to distinguish between species of the same kind and not to express any kind of mutual order between the species.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

LIST OF REFERENCE NUMERALS

2, 2*a*, 2*b*, 2*c*. Heat transfer plate
4. Plate front side
5, 5*a*, 5*b*, 5*c*. Gasket
6. Plate back side
7. Front gasket side
8. Long side
9. Back gasket side
10. Long side
11. Annular gasket part
12. Short side
13. Semi-annular gasket part
14. Short side
15. Inner edge
16. Longitudinal center axis
17. First section
18. Transverse center axis
19. Second section
20. First plate area
21. Inner gasket portion
22. Second plate area
23. Intermediate gasket portion
24. Third plate area
25. Outer gasket portion
26. Fourth plate area
27. Front gasket groove
28. Distribution area
29. Projection
30. Heat transfer area
31. Projection
32. Outer edge portion
33. Inner surface
34. Outer plate edge
35. Inner gasket portion
36. Corrugations
37. Intermediate gasket portion
38. First plane
39. Back gasket groove
40. Second plane
41. Outer gasket portion
42. Intermediate plane
44. First porthole area
46. Second porthole area
48. First port hole
50. First inner edge
52. First section
54. Second section
56. First inner port portion
58. First intermediate portion
60. First outer portion
62. First support projection
64. First top portion
66. Third plane
68. Positioning projection
70. Positioning recess
72. Fourth plane
74. Positioning recess
76. Second port hole
78. Second inner edge
80. First section
82. Second section
84. Second inner port portion
86. Second intermediate port portion
88. Second outer port portion
90. Second support projection
92. Second top portion
94. Positioning projection
96. Positioning recess

The invention claimed is:

1. A heat transfer plate comprising at least one first port hole area, opposing front and back sides and an outer edge portion comprising corrugations extending between and in first and second planes defining an extension of the heat transfer plate, which first and second planes are parallel to each other and to an intermediate plane extending between the first and second planes, the front and back sides of the heat transfer plate facing the first and second planes, respectively, wherein each of said at least one first port hole area comprises a first port hole defined by an annular first inner edge of the heat transfer plate, said first inner edge consisting of a first and a second section, which first section is 25-65% of the first inner edge, a front gasket groove on the front side of the heat transfer plate extending along the first section of said first inner edge, and a back gasket groove on the back side of the heat transfer plate extending along the first and second sections of said first inner edge, each of said at least one first port hole area further comprising an annular first inner port portion extending along the first and second sections of said first inner edge, a first intermediate port portion encircling the first inner port portion, and a first outer port portion encircling the first intermediate port portion, the front and back gasket grooves extending within the first inner, intermediate and outer port portions, the first inner port portion comprising, as seen from the front side of the heat transfer plate, a number ≥1 of first support projections along the second section of the first inner edge, each of said number of first support projections comprising a first top portion extending in the first plane, and the heat transfer plate extends, within the first inner port portion and outside said number of first support projections, at a distance ≠0 from the first and second planes.

2. A heat transfer plate according to claim 1, which extends, within the first inner port portion and outside said number of first support projections, in the same plane as the first inner edge, along the first inner edge.

3. A heat transfer plate according to claim 1, wherein the first inner port portion is essentially plane, and extends in the intermediate plane, along the complete first section of the first inner edge.

4. A heat transfer plate according to claim 1, wherein each of the first top portions of said number of first support projections extends from the first inner edge.

5. A heat transfer plate according to claim 1, wherein the first intermediate port portion comprises, as seen from the front side of the heat transfer plate, a number ≥1 of positioning projections and a number ≥1 of positioning recesses along the first section of the first inner edge.

6. A heat transfer plate according to claim 1, wherein the first intermediate port portion comprises, as seen from the front side of the heat transfer plate, a number ≥1 of positioning recesses along the second section of the first inner edge.

7. A heat transfer plate according to claim 1, wherein the number of first support projections along the second section of the first inner edge is >1, and wherein the first inner port portion, between two adjacent ones of the first support projections, extends between the intermediate plane and the second plane.

8. A heat transfer plate according to claim 1, wherein the first outer port portion is essentially plane, and extends in the intermediate plane, along the complete first and second sections of the first inner edge.

9. A heat transfer plate according to claim 1, comprising at least one second port hole area, wherein each of said at least one second port hole area comprises a second port hole defined by an annular second inner edge of the heat transfer plate, said second inner edge consisting of a first and a second section, which first section is 25-65% of the second inner edge, the front gasket groove extending along the first and second sections of said second inner edge, and the back gasket groove extending along the first section of said second inner edge, each of said at least one second port hole area further comprising an annular second inner port portion extending along the first and second sections of said second inner edge, a second intermediate port portion encircling the second inner port portion, and a second outer port portion encircling the second intermediate port portion, the front and back gasket grooves extending within the second inner, intermediate and outer port portions, wherein the second inner port portion comprises, as seen from the back side of the heat transfer plate, a number ≥1 of second support projections along the second section of the second inner edge, each of said number of second support projections comprising a second top portion extending in the second plane, and the heat transfer plate extends, within the second inner port portion and outside said number of second support projections, at a distance ≠0 from the first and second planes.

10. A heat transfer plate according to claim 9, which extends, within the second inner port portion and outside said number of second support projections, in the same plane as the second inner edge, along the second inner edge.

11. A heat transfer plate according to claim 9, wherein longitudinal and transverse centre axes of the heat transfer plate, which extend parallel to the intermediate plane and perpendicular to each other, define a first, a second, a third and a fourth plate area, wherein the first and second plate areas are arranged on the same side of the transverse centre axis and the first and the third plate areas are arranged on the same side of the longitudinal centre axis, wherein the first and third plate areas each comprise one of said at least one first port hole area and the second and fourth plate areas each comprise one of said at least one second port hole area, wherein the first and second port hole areas are symmetrically arranged with reference to the transverse and longitudinal centre axes.

12. A gasket for sealing between two adjacent heat transfer plates in a plate heat exchanger, comprising opposing front and back sides configured to abut a respective one of the heat transfer plates and at least one annular gasket part configured to seal around two overlapping port holes in the heat transfer plates, an inner edge of the annular gasket part consisting of a first and a second section, which first section is 25-65% of the inner edge, the annular gasket part comprising an annular inner gasket portion defining, and extending along the first and second sections of, the inner edge of the annular gasket part, an intermediate gasket portion encircling the inner gasket portion and an outer gasket portion encircling the intermediate gasket portion, the inner gasket portion having a maximum thickness t1 along the complete inner edge except at a number ≥1 of locations along the second section of the inner edge where the inner gasket portion, at each of said locations, comprises a projection projecting from the front side and a projection projecting from the back side so as to give the inner gasket portion a maximum thickness t2, t2>t1.

13. A gasket according to claim 12, wherein the inner gasket portion has an essentially constant cross section along the complete first section of the inner edge.

14. A gasket according to claim 12, wherein the outer gasket portion has an essentially constant cross section and a maximum thickness t3 along its complete extension.

15. A gasket according to claim 14, wherein the intermediate gasket portion has, along its complete extension, a thickness ≤t3, and, along at least a part of its extension, a thickness <t3.

16. A gasket according to claim 12, wherein said number of locations along the second section of the inner edge is >1, and wherein the maximum thickness of the inner gasket portion is locally decreased, in relation to the maximum thickness of the inner gasket portion along the first section of the inner edge, between two adjacent ones of said locations.

17. A gasket according to claim 12, wherein an inner surface of the inner gasket portion extending between the front and back sides of the gasket is convex along at least a part of the second section of the inner edge.

* * * * *